United States Patent [19]

Mauger et al.

[11] Patent Number: 4,527,376

[45] Date of Patent: Jul. 9, 1985

[54] APPARATUS FOR PROCESSING BOX PARTITIONS

[75] Inventors: David W. Mauger, Wilton, Conn.; James W. Lawrie, Capitola, Calif.; John T. McCarthy, N. Falmouth, Mass.; Michael A. Tozzi, Mequon, Wis.

[73] Assignee: Clevepak Corporation, Milwaukee, Wis.

[21] Appl. No.: 210,541

[22] Filed: Nov. 28, 1980

[51] Int. Cl.[3] ..... B65B 27/08

[52] U.S. Cl. ..... 53/113; 53/542; 53/587; 493/311; 493/312

[58] Field of Search ..... 493/311, 312; 53/443, 53/399, 500, 589, 580, 542, 113, 582; 100/14; 414/225

[56] References Cited

U.S. PATENT DOCUMENTS

| | | | |
|---|---|---|---|
| 2,758,521 | 8/1956 | Shields | 493/311 |
| 2,767,625 | 10/1956 | Schroeder | 93/37 |
| 2,842,035 | 7/1958 | Larkin | 53/589 |
| 3,019,886 | 2/1962 | Winkler | 53/542 |
| 3,085,501 | 4/1963 | Wimmer | 100/14 |
| 3,143,217 | 8/1964 | Andersen | 414/225 |
| 3,348,473 | 10/1967 | Luy | 53/589 |
| 3,383,990 | 5/1968 | Cheu | 493/311 |
| 3,646,857 | 3/1972 | McDougal | 93/37 |
| 3,809,593 | 5/1974 | Burke et al. | 93/37 |
| 3,834,115 | 9/1974 | Johnson | 53/500 |
| 3,998,136 | 12/1976 | Peters, Jr. | 93/37 |
| 4,058,226 | 11/1977 | Peters, Jr. | 214/7 |
| 4,170,170 | 10/1979 | Beasley et al. | 93/37 |
| 4,170,171 | 10/1979 | Beasley et al. | 93/37 |
| 4,170,928 | 10/1979 | Beasley et al. | 93/37 |

FOREIGN PATENT DOCUMENTS

| | | | |
|---|---|---|---|
| 567520 | 12/1958 | Canada | 198/628 |
| 333531 | 8/1930 | United Kingdom | 53/530 |

*Primary Examiner*—Nicholas P. Godici
*Assistant Examiner*—Marc Hodak
*Attorney, Agent, or Firm*—Rogers, Eilers & Howell

[57] ABSTRACT

A collapser/collector and strapping apparatus for processing box partitions to place them in condition for shipment. The assembled partitions are collapsed and moved vertically into transversely indexed slots of a collector. From the indexed slots, the partitions are placed into bundles of a preselected number of partitions. The bundles are then delivered to a strapping section where straps are applied to hold each bundle together for further processing.

34 Claims, 39 Drawing Figures

22
24
28
296
358
360
356
328
334
336
402
400
404
396
406
408
383
384
385
386
388
376
378
380
374
382
430
434
440
428
318
319
314
316
324
326
342

27
27
22
22
52
24
160
162
230
232
238
240
242
244
252
254
256
260
264
266
268
269
270
272
274
275
276
278
220
226
228
250
314
319
324
428

464
32
476
612
592
472
470
468
610
606
602
608
474
478
462
466
24
438
30
590
528
502
512
484
31
518
508
526
522
624
628
630
620
578
626
34
538
542
530
550
560
582
29
33
600
604
284
282

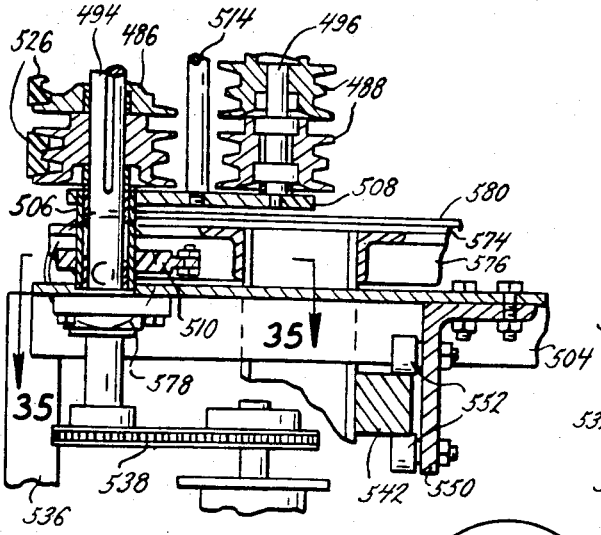
FIG. 34.
FIG. 35.
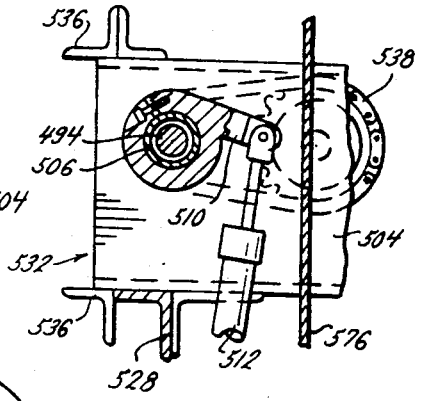
FIG. 30.
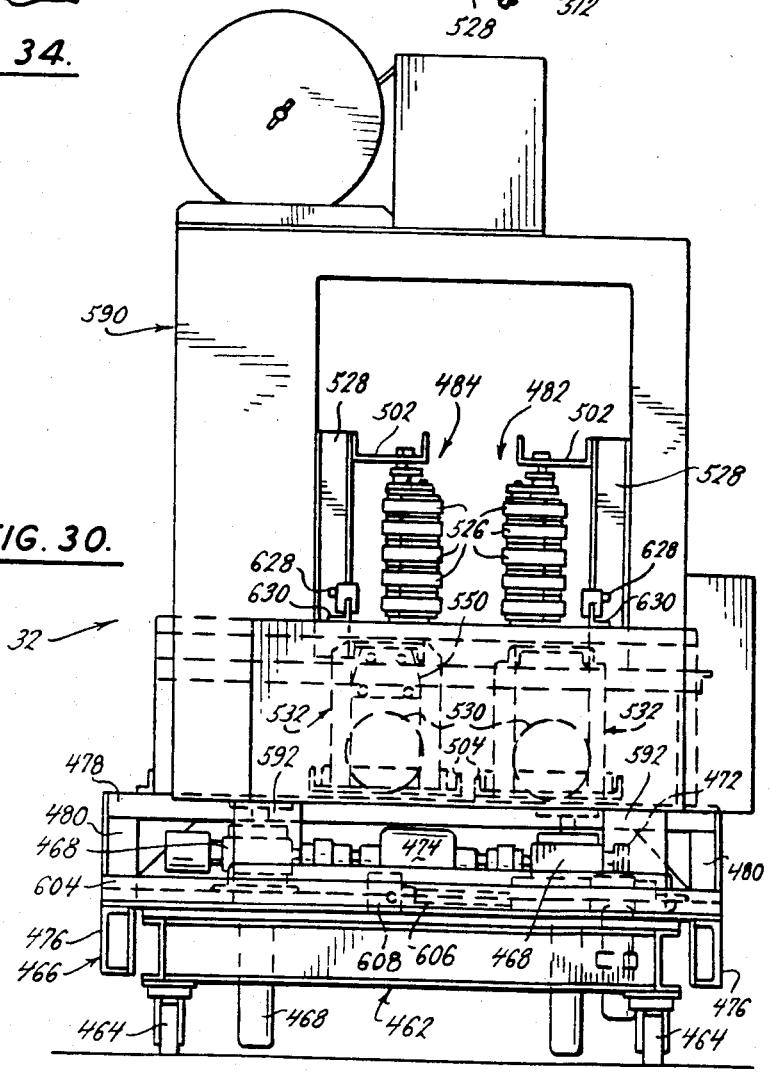

APPARATUS FOR PROCESSING BOX PARTITIONS

BACKGROUND AND SUMMARY OF THE INVENTION

The method and apparatus of this invention relate to the processing of partitions, and more specifically box partitions which may be of the paperboard, corrugated, solid fiber, chipboard, plastic or the like type having longitudinal and cross partition strips interengaged to define cells into which containers or the like are inserted.

Partitions of this general type are well known in the art and are exemplified by those shown and described in U.S. Pat. Nos. 3,948,435, and 4,000,845, the entirety of which are incorporated herein by reference. Assembly machines for assembling partitions of these types are also well known in the art and are exemplified by the assembly machine shown and described in U.S. Pat. No. 2,163,923, the entirety of which is incorporated herein by reference.

Assembly machines of this general type assemble the partition by successively feeding transverse partition strips downwardly into engagement with parallel longitudinal partition strips, with the assembled partition being in an open configuration (the same configuration as when it is placed in the box). Other assembly machines assemble the longitudinal and cross strips in a nearly closed or partially open configuration.

Heretofore it has been customary to manually process the partitions after assembly. This has required manually collapsing each partition, counting the partitions, placing the partitions in bundles of selected numbers of partitions, and strapping or tieing the bundles for shipment. These manual operations are time consuming and costly. One type of automatic stacker for use with a particular type of assembly machine is shown by U.S. Pat. Nos. 3,998,136 and 4,058,226. In these patents, the partitions are assembled in a partially open configuration and are generally horizontally oriented. The horizontal partitions are sequentially dropped onto a conveyor and then stacked. It should be noted that in these references the partitions are assembled and stacked from a horizontal orientation rather than in a vertical orientation as with the present invention.

Thus, it is a primary object of the present invention to provide an apparatus and method for automatically collapsing partitions in a vertical orientation, and collecting the collapsed partitions into bundles of preselected numbers of partitions. It is a further object to automatically strap bundles of partitions for further processing such as shipping.

Generally, in accordance with the invention, the assembled partitions are collapsed to a vertical orientation and then carried by driven bands to a collector section. The collector section has upper and lower tracks defining vertical slots. The tracks, and hence the slots, index or advance transversely relative the path of travel of the collapsed partitions to position an empty slot in line with each collapsed partition as it enters the collector. The collapsed partitions are moving continuously to the collector with the track drives disengaging to receive each partition in a vertical slot, and then engaging to move the partition transversely.

Upon leaving the tracks, partitions are gathered in bundles with the partitions again oriented vertically within the bundle. From the collector, the bundles are conveyed to a strapping section where straps are automatically applied for further processing.

The entire apparatus of the invention operates automatically, and is fully adjustable to accommodate partitions of various dimensions and bundles of various sizes.

These and other objects and advantages of the invention are apparent from the drawings and detailed description to follow.

DESCRIPTION OF THE DRAWINGS

FIG. 30 is a view in section taken generally along the line 30—30 of FIG. 28;

FIG. 34 is an enlarged view in section taken generally along the line 34—34 of FIG. 32;

FIG. 35 is a view in section taken generally along the line 35—35 of FIG. 34;

DETAILED DESCRIPTION OF A PREFERRED EMBODIMENT

Figure 2:
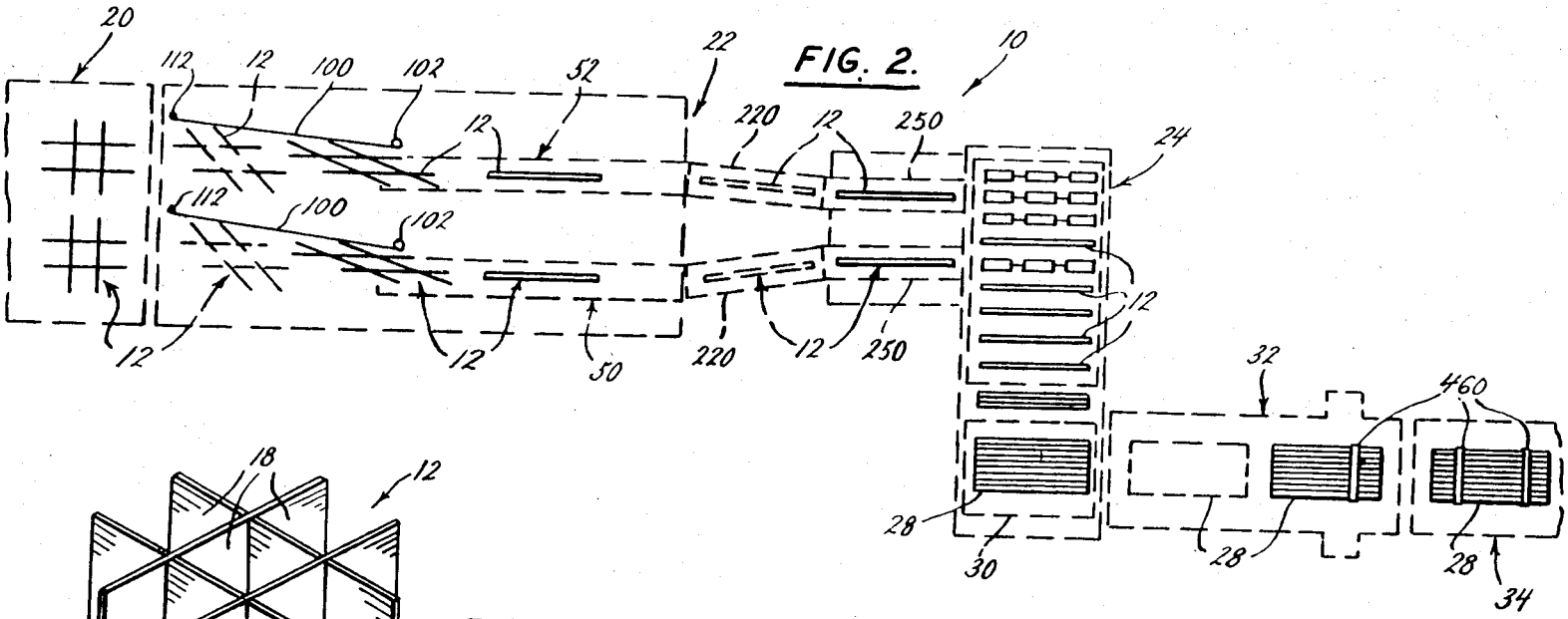
FIG. 2 is a schematic plan view showing the collapsing and collecting of the partition assembly of FIG. 1.
Figure 1:
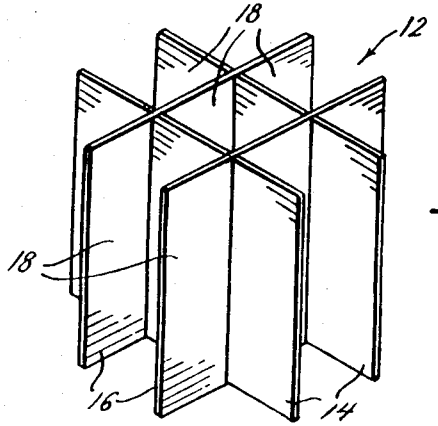
FIG. 1 is an isometric view of a typical partition assembly processed by the method and apparatus of the invention.

By way of general description, and with particular reference first to FIGS. 1 and 2, the machine 10 of this invention is shown schematically in FIG. 2 for processing a partition 12 of FIG. 1. The partition 12 may be of a standard type made of paperboard or other suitable materials, for use in boxes to separate cans, bottles, and the like. Typically, such a partition includes longitudinal partition strips 14 and transverse partition strips 16, which are interengaged to define cells 18 for receiving the containers to be packaged. Such partitions are collapsible and typically are shipped in a flat configuration.

Generally, in accordance with the invention, the partitions are first assembled at a partition assembly machine 20, which may be generally of the type disclosed in U.S. Pat. No. 2,163,923, the entirety of which is incorporated herein by reference. In the assembly machine 12, the cross partition strips 16 are fed vertically downwardly into engagement with the longitudinal strips 14 which are fed to the assembly point in parallel relation. In accordance with the present invention, the assembled partitions are fed to a collapser portion 22 which automatically collapses the partitions to a flat configuration and feeds them vertically into a collector section 24 by means of an infeed mechanism. At the collector section 24, the partitions are moved transversely to their former path of travel and assembled into a bundle 28 of a selected number of partitions. The bundle is further moved along the transverse path onto a conveyor 30, and thence along a path parallel to the initial partition path to a strapping station 32. At the strapping station, the bundles are automatically strapped or banded and from there moved onto another conveyor 34 for further processing, such as packaging, shipping, and the like.

In describing the apparatus and method of the invention in more detail, first the collapser section will be described, followed by the collector, and then the strapper.

Collapser

The collapser section 22 is shown, at least in part, in FIGS. 3 through 14. Initially, with reference to FIGS. 3 and 4, the assembled partitions are fed from the assembler 20 to the collapser section 22. The collapser has a lower feed portion 40 and an upper feed portion 42. The lower feed portion 40 comprises a conveyor table 44 driven by a suitable motor and drive mechanism 46, and supported on motor jacks 48 for adjusting the height of the conveyor to accommodate partitions of different heights. One end of the conveyor may be pivotally mounted to the assembly table 49 of the assembly machine 20 for vertical adjustment therewith. It should be noted that in this described embodiment, the height of the upper feed portion 42 remains fixed, while it is the height of the lower feed portion 40 that is adjustable for partitions of different heights.

The upper feed portion 42 has feed paths or lines 50 and 52 for feeding the partition from the assembly machine 20 to the collector 24. While two feed lines are shown, it is to be understood that there can be a fewer or greater number of lines depending on the number of partitions to be processed simultaneously. The feed lines are supported on suitable frames 54, 56 and 58 with the frames 54 and 56 straddling the conveyor 44.

In addition to vertical adjustment to accommodate partitions of different heights, the machine must be adjustable to accommodate the length and transverse spacing of the partitions. Thus, each of the feed lines 50 and 52 is transversely adjustable, as is also the location at which the feed line picks up the assembled partition from the assembly machine.

The feed lines 50 and 52 are identical, and each may be considered as having an upstream section 60 (FIG. 3) which first collapses the partition and then grips the upper edge of the partition to feed it vertically toward the collector, an intermediate feed section 62, and an in-feed section 64 that directs the partition into the collector.

First, with reference to the upstream section 60, when the last cross partition strip is in place and the assembly of the partition is completed by the assembly machine 20, the top edge of the open partition is engaged by a band 70 (FIGS. 4 and 5) at a location 72 which is adjustable as will be further explained. The band engages the top edges of the cross partition strips 16 to one side of a longitudinal partition strip 14 so as to miss any notch that may be at the upper edge of the cross partition strip to ensure a firm grip of the band 70 with the top of the partition, or alternatively the band may engage within the notch.

The band 70 is driven along with the conveyor 44 to move the partition toward the collector. The drive for the band 70 includes pulleys 74, 76, 78 and 80 about which the band travels as shown. The pulleys 74 and 80 are mounted on a contilevered bar 82, the rear end of which is secured to one end of a channel bar 84. The rearward end of the channel bar is secured within a slide block 86 (FIGS. 5B and 10), the purpose of which will be explained.

The pulley 76 is adjustable along the path of the partition so that the pick up point 72 can be adjusted for partitions of various lengths. This is important because the partition is not picked up by the collapser section until the last cross partition strip is in place. To provide this adjustability, the pulley 76 is mounted to a bracket 88, the upper end of which has a C-shaped recess 90 which receives the bar 82 so that the bracket 88 slides along the bar. The bracket 88 has a back plate 92 and a spring biased pin mechanism 94 for selective engagement with holes 96 in the bar 82. A threaded knob 98 is provided to secure the bracket 88 at a selected position on the bar if desired. Thus, it can be seen that the bracket 88 and pulley 76 can be adjusted along the bar 82 between the solid line position and the dashed line position of FIG. 5A to adjust the pick up point 72.

To collapse the partition as it is moved by the conveyor and band 70, the side edges of the partition are moved into contact with an angled rail 100, which in this described embodiment is a negator spring. The spring 100 has its rearward end coiled onto a spool 102 (FIGS. 3 and 5B) mounted to a shaft 104 depending from a mounting plate 106. The forward end of the spring is secured by means of a pin and socket assembly 110 (FIGS. 5A and 7–9) to the lower end of a vertical rod 112. The rod is secured by a clamp 114 which is secured to a locking plate 116. The clamp is tightened onto the rod by a bolt 118. The locking plate 116 is bolted at the lower end of a slide block 120 that is adjustably slidable within a transverse channel bar 122. (See also FIG. 3). This means that the front end of the guide spring 100 is transversely adjustable by loosening the locking plate 116 and moving the slide block 120 within the channel bar. In addition, the front end of the guide spring is also adjustable longitudinally along the path of the partition as will now be explained.

The transverse channel bar 122 is mounted at its ends by brackets 126 (FIG. 8) to slide blocks 128 that are slidably adjustable within longitudinal channel bars 130. The bars 130 are secured to the frame 54. Within the channel bars 130 are lead screws 132 threadedly engaged with the slide blocks 128 such that upon rotation of the lead screws, the slide blocks, and hence the transverse bar 122, are adjusted. The lead screws 132 are driven through chain and sprocket drives 134 and motor 136 also secured to the frame 54.

Thus, it can be seen that the forward end of the guide spring 100 is adjustable vertically, transversely, and longitudinally to accommodate variations in size and positioning of partitions. As the guide spring is adjusted longitudinally, it coils or uncoils, as appropriate, on the spool 102.

The band 70 is driven by driving the pulley 78 from a motor 140 and drive assembly 142 which are mounted on the plate 106. More specifically, the motor 140, which is mounted to the plate 106 by channels 144 (FIG. 5B), drives a gear box 146 through a belt drive 148. The pulley 78 is driven through a gear box 150 and a belt drive 152 from the gear box 146.

Figure 12:
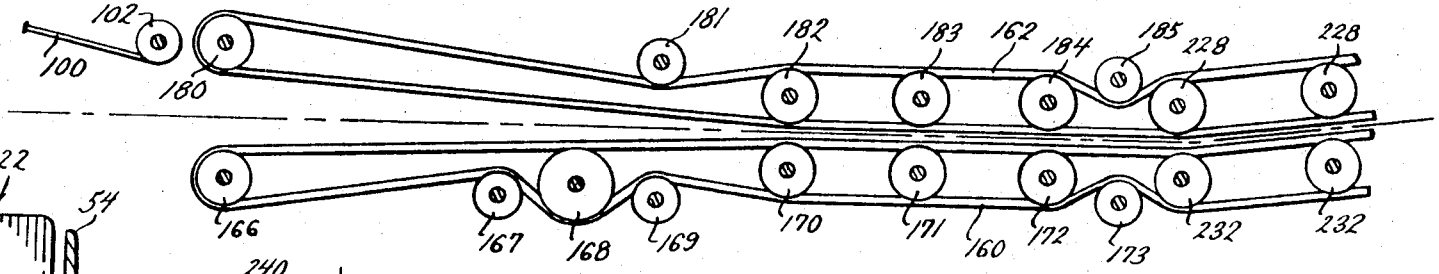
FIG. 12 is a view in section taken generally along the line 12—12 of FIGS. 5B and 5C.
Figure 5C:
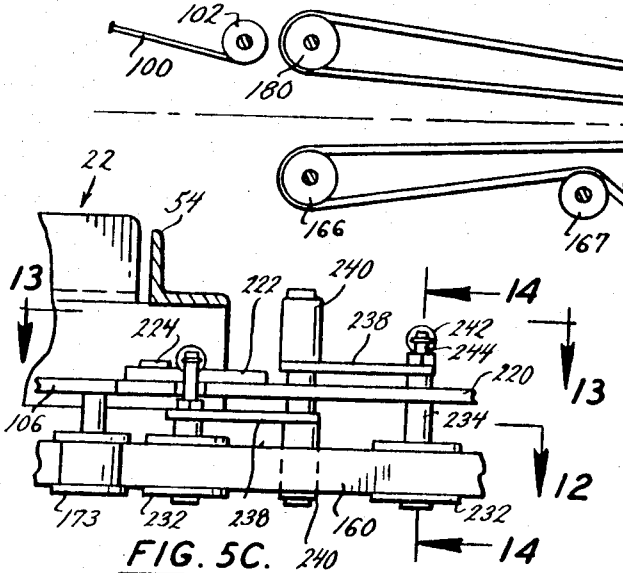
Figure 14:
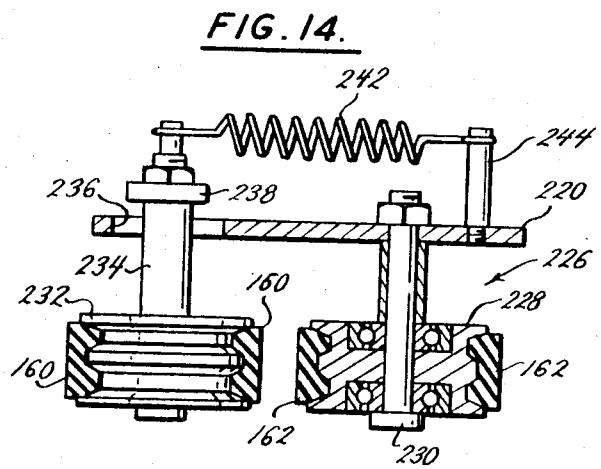
FIG. 14 is an enlarged view in section taken generally along the line 14—14 of FIG. 5C.
Figure 13:
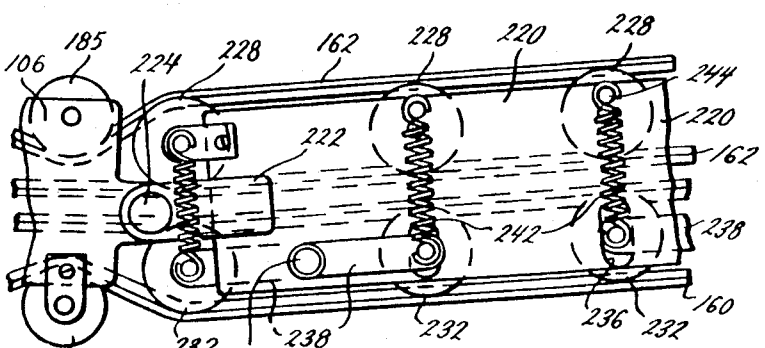
FIG. 13 is a view in section taken generally along the line 13—13 of FIG. 5C.
Figure 15:
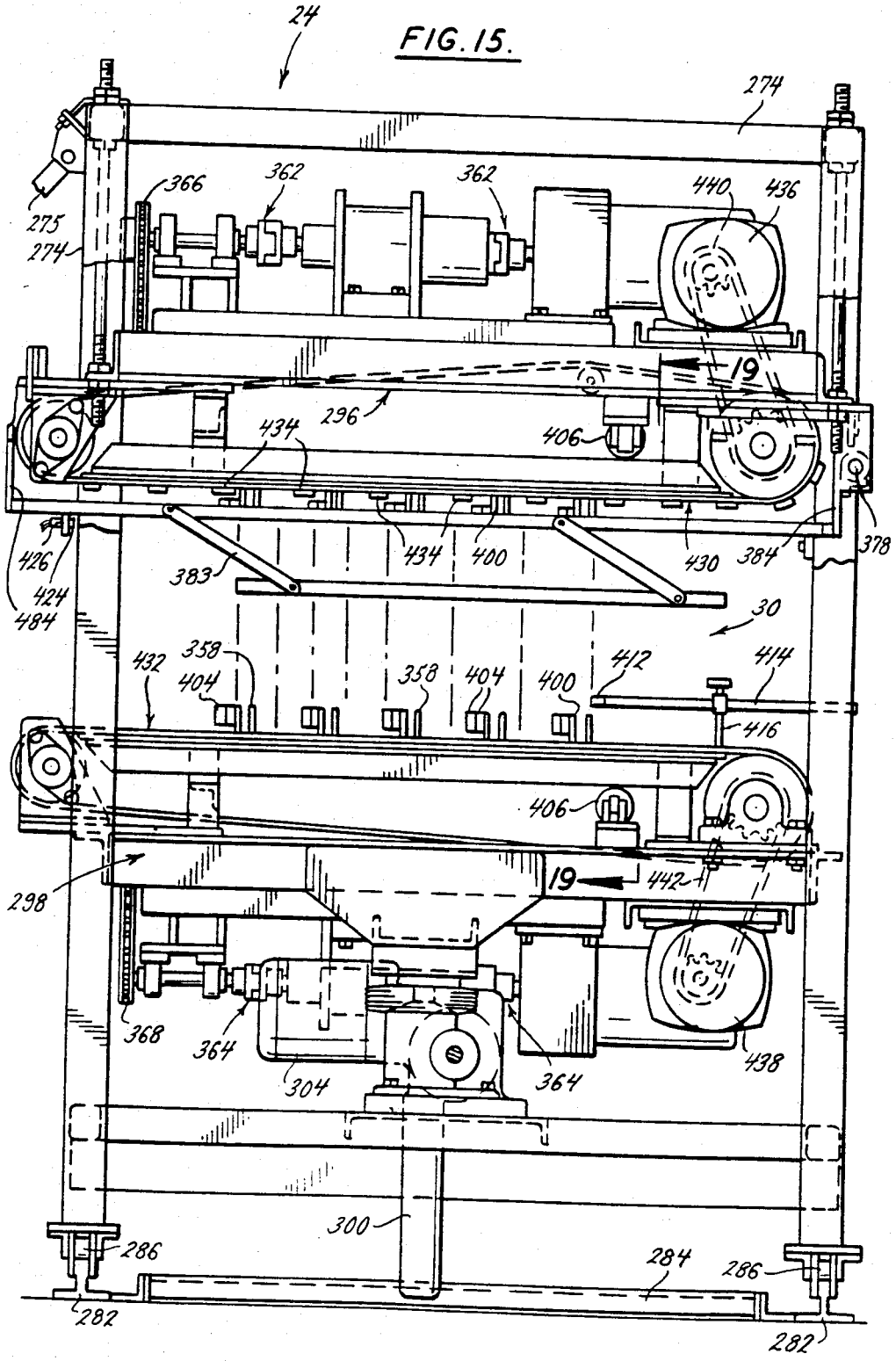
FIG. 15 is a right side elevation of the collector portion of the invention as viewed from the upstream side of the apparatus.

The same motor and drive assembly 140 and 142 also drive belts or bands 160 (FIGS. 4, 5B and 12) and 162. These bands pick up the partition from the conveyor and band 70, and grip or sandwich the collapsed partition at its upper edge and move it toward the collector section 24. In the section 60, the band 160 passes over pulleys 166 through 173, with the pulley 168 being the driving pulley. The band 162 passes over pulleys 180 through 185. As shown in FIG. 12, the bands 160 and 162 converge from their front end to the approximate location of the pulleys 170 and 182 so that the collapsed partition enters at the relatively wide opening at the front of these bands and is then gripped at its upper edge as it moves therebetween.

The pulley 168 is driven by the motor 140 through the belt drive 148 and gear box 146. All of the pulleys 166 through 176 and 180 through 188 are mounted to the plate 106. The plate 106 of each feed line 50 and 52, and all that is mounted thereto, is transversely adjustable as will now be explained.

Figure 3:
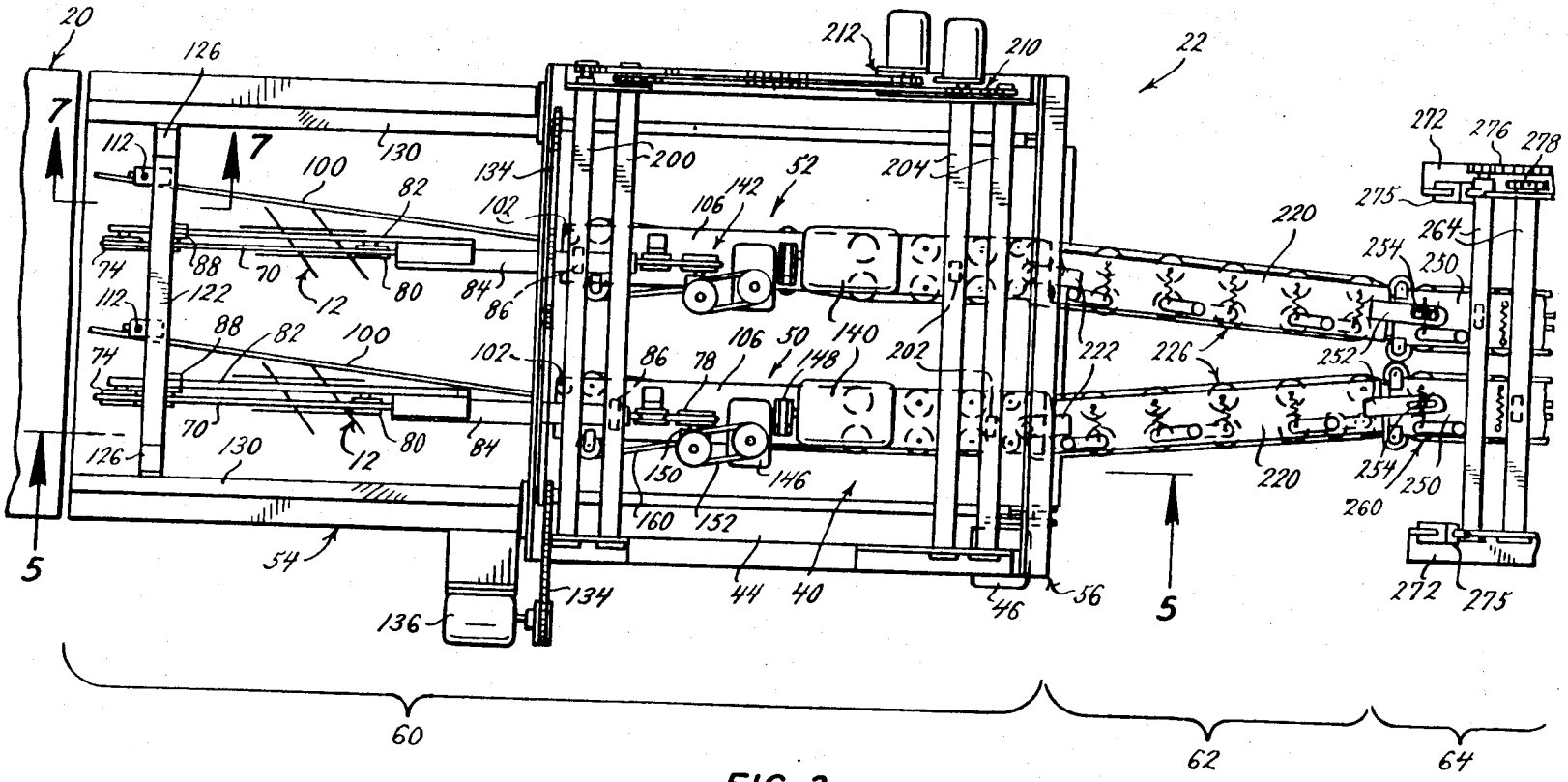
FIG. 3 is a plan view of the collapser portion of the apparatus including the intermediate and in-feed sections.
Figure 4:
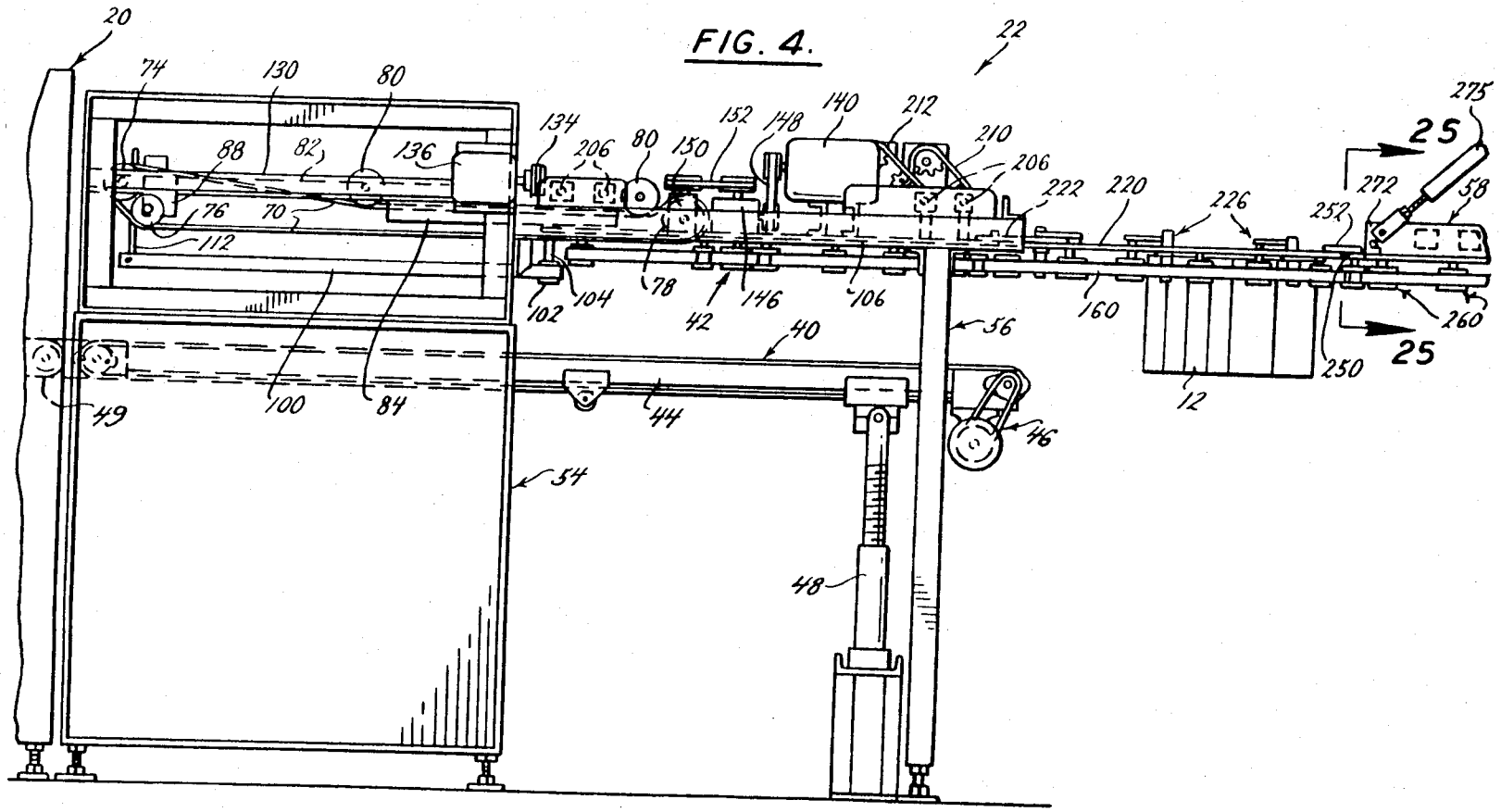
FIG. 4 is a side elevation view of the collapser portion of FIG. 3.
Figures 5A, 6, 7, 8, 9:
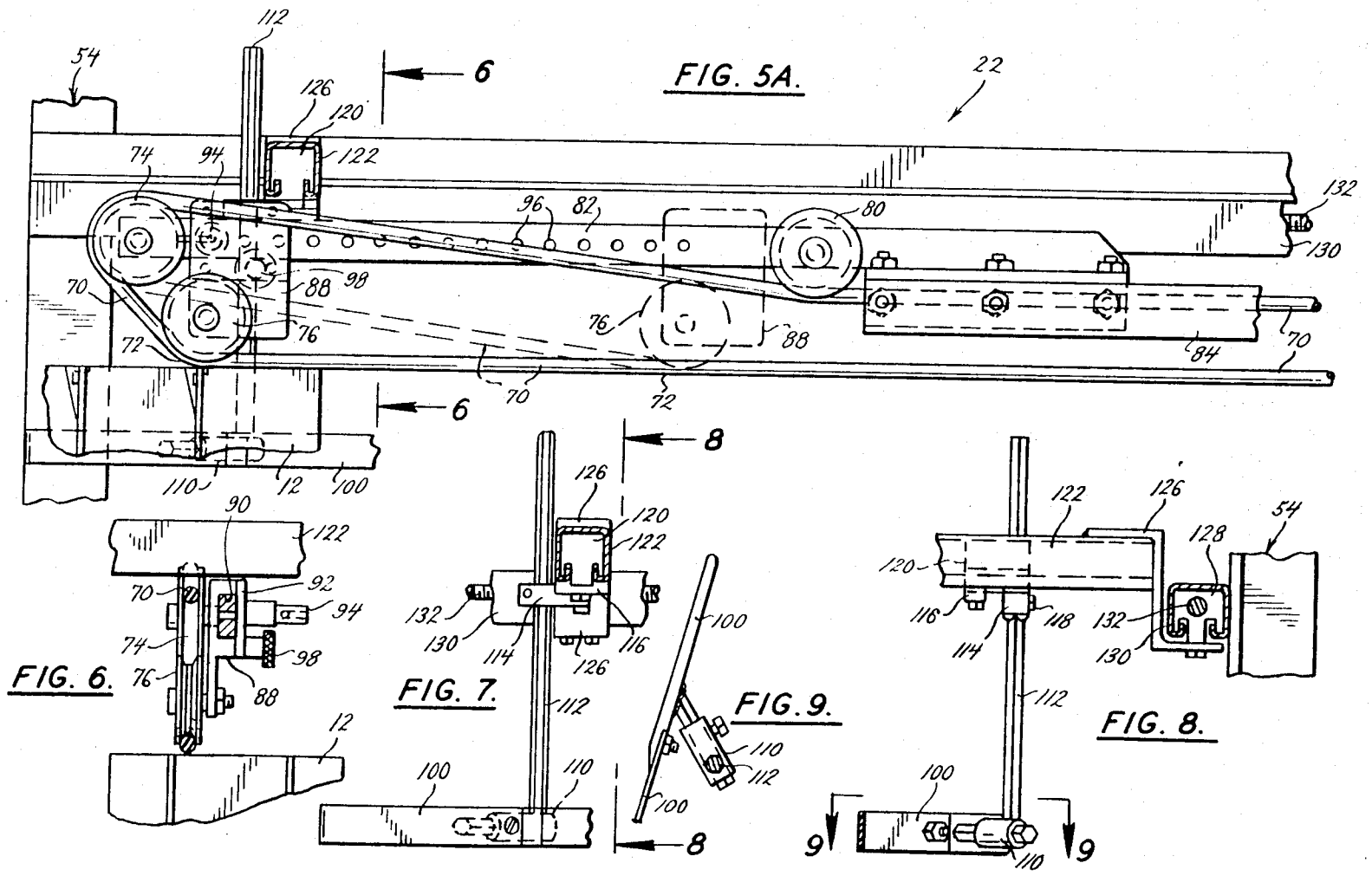
FIGS. 5A, 5B and 5C, are enlarged side elevation views of the collapser portion taken generally along the line 5—5 of FIG. 3.
FIG. 6 is a view in section taken generally along the line 6—6 of FIG. 5A.
FIG. 7 is an enlarged view in section taken generally along the line 7—7 of FIG. 3.
FIG. 8 is a view in section taken generally along the line 8—8 of FIG. 7.
FIG. 9 is a view in section taken generally along the line 9—9 of FIG. 8.
Figures 5B, 10, 11:
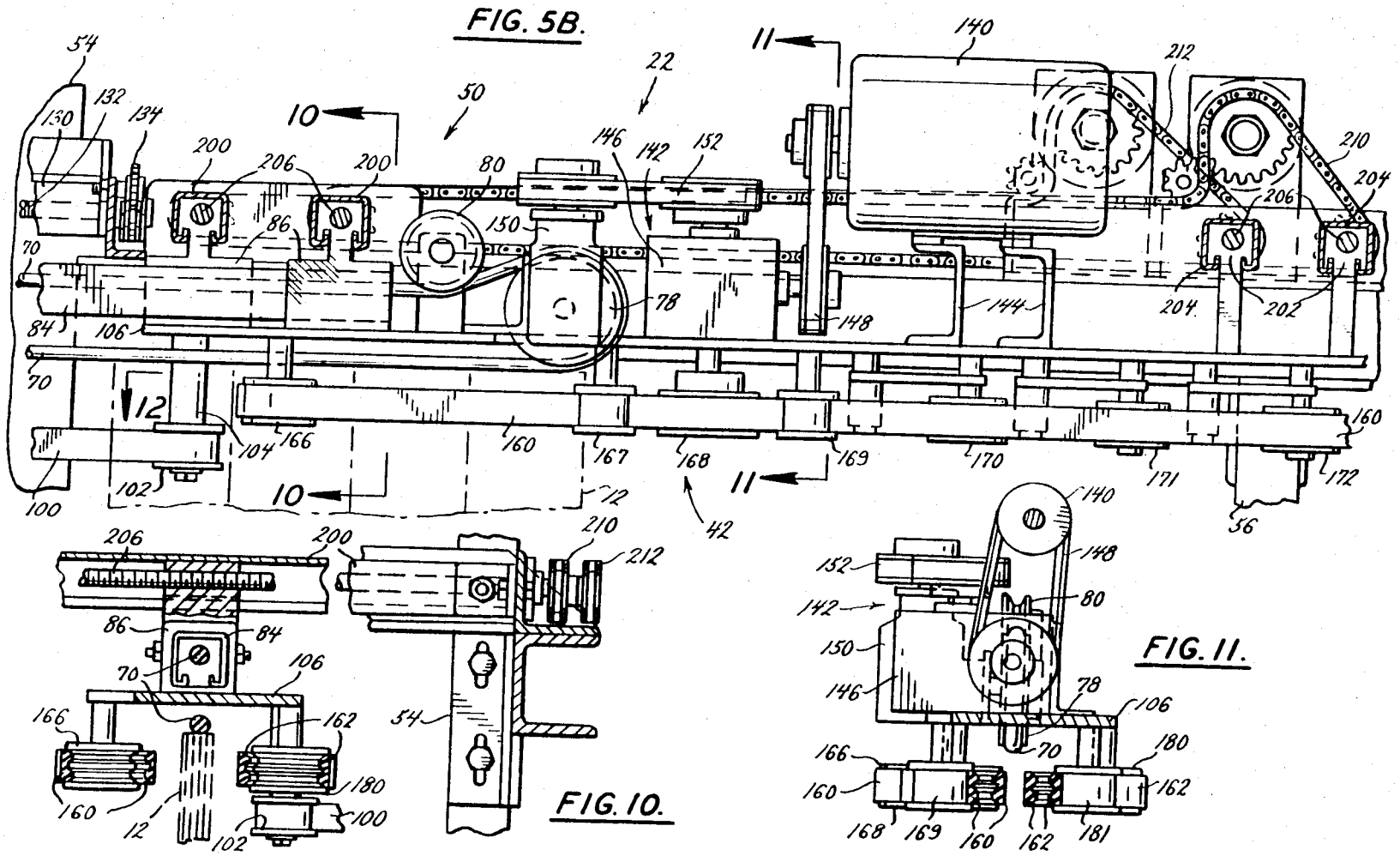
FIG. 10 is a view in section taken generally along the line 10—10 of FIG. 5B.
FIG. 11 is a view in section taken generally along the line 11—11 of FIG. 5B.

Each plate 106 is secured at its upstream end to a slide block 86 through which a channel bar 84 extends (FIG. 10). The slide block 86 is slidingly adjustable within a transverse channel bar 200 (FIGS. 3 and 5B). The rearward end of the plate 106 is mounted to a sliding block 202 which is slidingly adjustable within a transverse channel bar 204. Lead screws 206 extend within the channel bars 200 and 204 and threadedly engage the slide blocks 86 and 202. The transverse channel bars 200 and 204 are mounted to the frame 54. The lead screws 206 which transversely adjust the feed line 50 are driven by a motor and sprocket and chain drive 210. Similarly, the lead screws 206 which transversely adjust the line 52 are driven by a motor and chain drive 212.

Thus, it can be seen that the entire upstream section 60 of each feed line 50 and 52, including the motors 140 and drives 142, the various pulleys, the bands 160 and 162, the band 70, and the cantilevered arms that carry the band 70, are transversely adjustable along a pair of channel bars 200 and 204 by operation of the motor and chain drives 210 or 212.

Intermediate section 62 of each of the feed lines has a mounting plate 220 (FIGS. 3, 4, 5C and 13), similar to the plate 106 of the upstream section. The plate 220 is pivotally mounted to the end of the plate 106 by a tongue extension 222 and pivot pin 224. Mounted to the plate 220 are pairs of spring biased pulley assemblies 226 (see also FIG. 14), for biasing the bands 160 and 162 in gripping relation with the partition. Each pulley pair includes a fixed pulley 228 mounted to the plate 220 by means of a bolt and sleeve 230. A floating pulley 232 has a shaft 234 mounted for pivotal movement within a slot 236 of the plate. The pivotal movement is provided by a pivot arm 238, one end of which is pivotally mounted to the pulley shaft 234 and the other end pivotally mounted to the plate 220 at a post 240. A spring 242 has one end attached at the top of the shaft 234 of the pulley 232, and the other end to a pin 244 mounted to the plate 220. The band 160 travels over the pulleys 232, and the band 162 travels over the pulleys 228. Thus, it can be seen that the springs 242 bias the pulleys 232 toward the pulleys 228, and hence the band 160 toward the band 162 to grip or sandwich the partition therebetween. With the bands 160 and 162 driven in opposite directions, the partitions are moved toward the in-feed section 64.

With reference to FIGS. 3, 4 and 25 through 27, the in-feed section 64 of each of the feed lines 50 and 52 also has a mounting plate 250 similar to the mounting plates 220 and 106 of the sections 62 and 60. The end of the mounting plate 250 is pivotally and slidingly mounted at the end of the plate 220 by means of a tongue 252 at the end of the plate 220, and a pivot pin 254 mounted to the plate 250 and which extends within a slot 256 in the end of the tongue. The pin and slot allow the plates 220 and 250 to both pivot and move longitudinally relative to each other. Spring biased pulley pairs 260 are located along the plate 250 and are essentially identical to the pulley pairs 226. The band 160 continues around the spring biased pulleys of the pulley pairs 260, and the band 162 extends around the fixed pulleys so that the band 160 is biased into engagement with the partition as it moves toward the collector.

Figure 17:
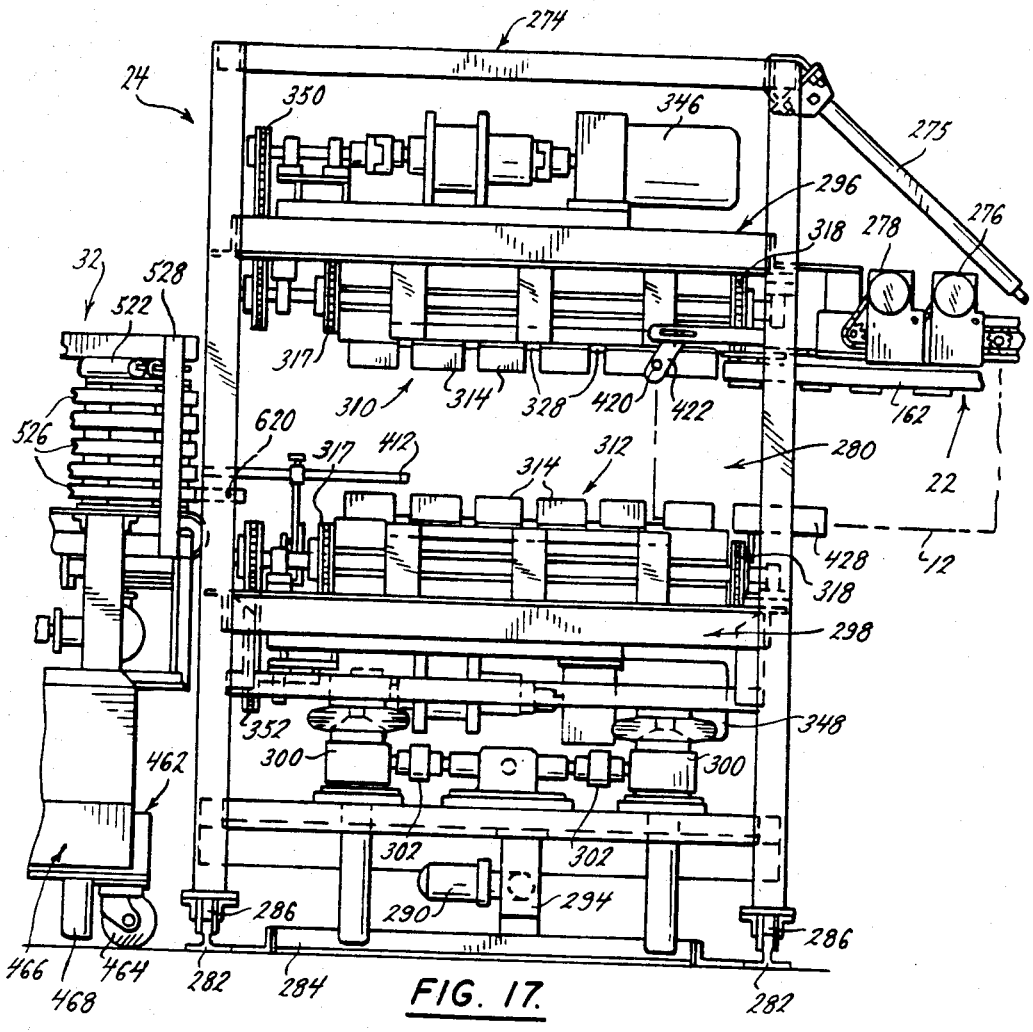
FIG. 17 is a left end elevation of the collector portion as viewed upstream of the apparatus.
Figure 25:
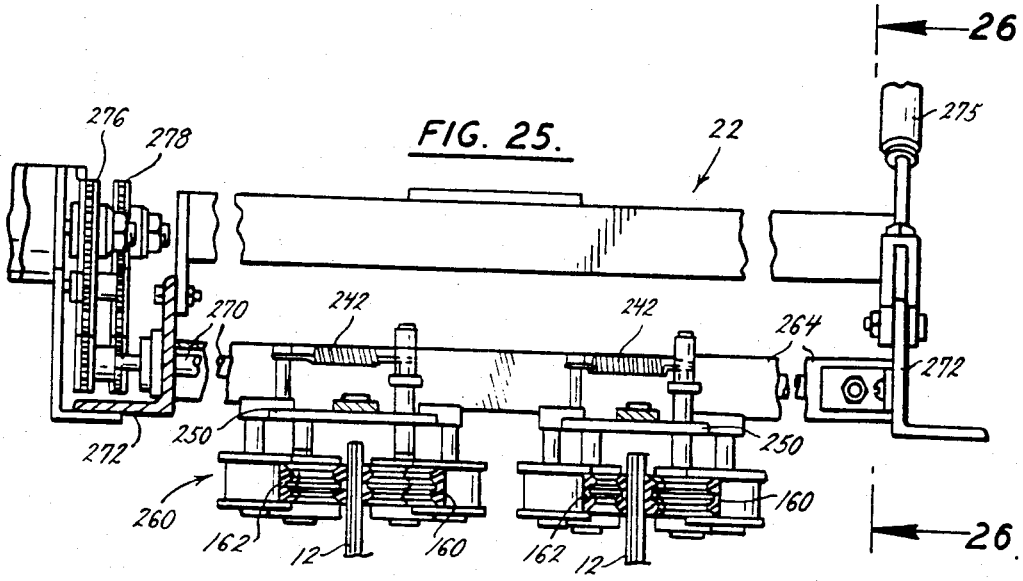
FIG. 25 is an enlarged view in section taken generally along the line 25—25 of FIG. 4.

The plates 250 of the in-feed sections 64 are mounted for transverse adjustment very similar to the way in which the plates 106 of the upstream section 60 are so mounted. Thus, each of the plates 250 is mounted for sliding adjustment along a transverse channel bar 264 and a transverse channel bar 266 by means of sliding blocks 268, and 269, each having a lead screw 270 threadedly engaged therewith. The channel bars 264 and 266 are mounted to longitudinal side frame members 272 which are an extension of the frame 274 of the collector station 24 (FIG. 17). The frame members 272 are supported by tie rods 275. The lead screws are driven by motor and chain and sprocket drives 276 and 278. Hence, the in-feed section of the feed line 50 is adjustable transversely by operation of the motor and drive 278, and the in-feed section of the feed line 52 is adjustable transversely by operation of the motor and drive 276.

It will be noted that the pivotal connection of the intermediate section 62 to each of the sections 60 and 64, as well as the limited longitudinal movement provided by the slots 256, allows independent transverse adjustment of each of the sections 60 and 64. Thus, each of the lines 50 and 52 can be properly and accurately adjusted in the transverse direction by operation of the motor and drives 210, 212, 276 and 278.

Collector

With particular reference to FIGS. 15 through 24, the collector section 24 and parts thereof will be described.

Figure 16:
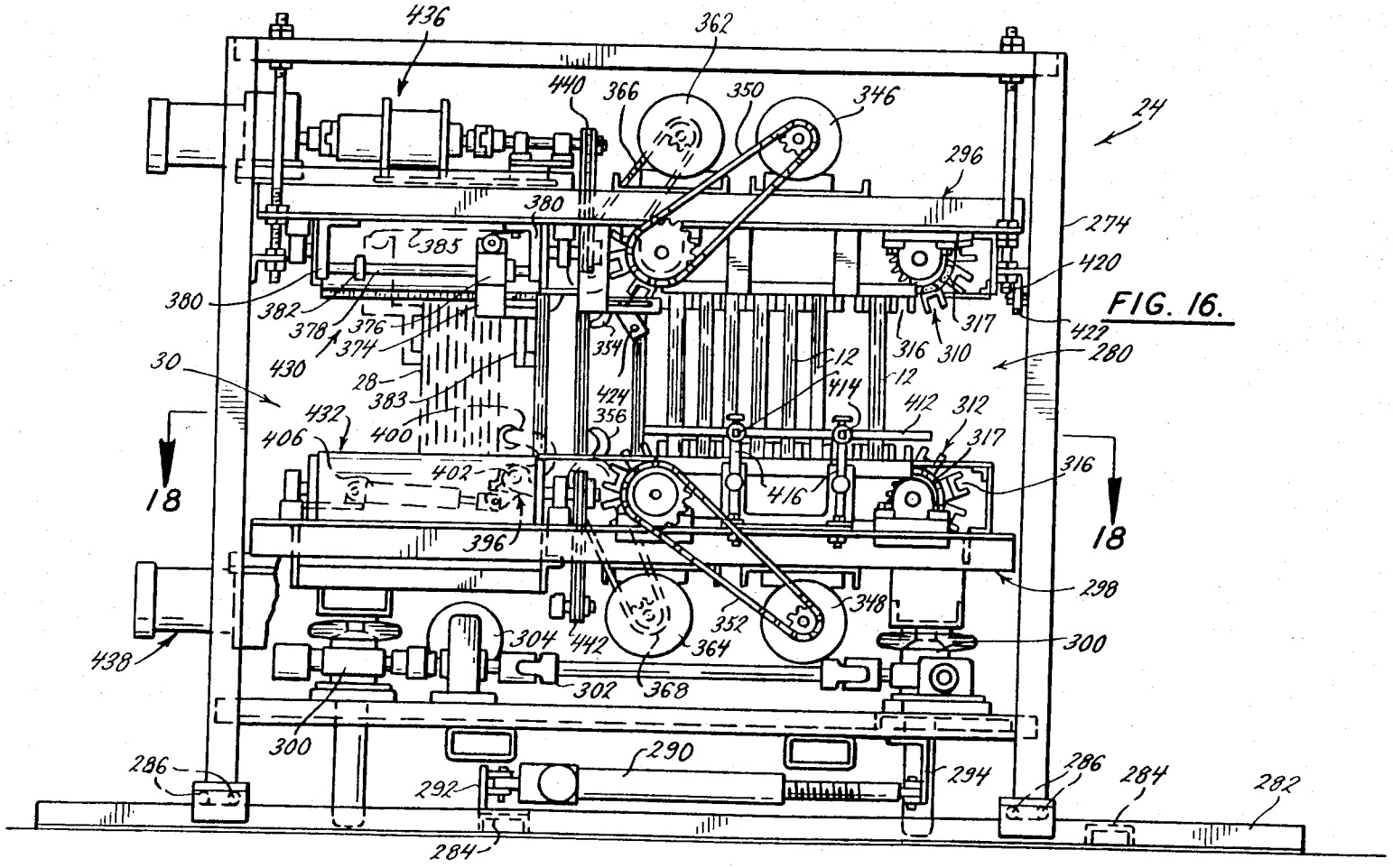
FIG. 16 is a rear end elevation view of the collector portion.

As previously explained, the collector section receives the collapsed vertical partitions from the collapser section and then moves them along a transverse path, places them in bundles, and then moves the bundles along a path generally parallel to the original path of the collapsed partition. Thus, the collector can be thought of as having a receiver section 280 and the conveyor section 30, although they are part of the same machine (FIG. 16).

The collector includes the frame 274 mounted for adjustable sliding movement on rails 282 held in spaced parallel relation by cross members 284. At the bottom of the frame 274 are rollers 286 so that the frame may move on the rails. A screw jack 290 has one end secured to a cross member 284 by a bracket 292 and the other end secured to a bracket 294 mounted to the frame 274. Hence, by adjusting the screw jack 290, the entire frame 274, and all the components mounted thereon, can be positioned laterally.

The frame 274 has an upper subframe 296 which is secured in fixed relation to the main frame, and a lower subframe 298 defining a table that is vertically adjustable relative to the main frame. This vertical adjustment is provided by three motor jacks 300 interconnected in a tripod arrangement by linkage and gear box drives 302 so that operation of a motor 304 causes all three of the motor jacks to operate simultaneously to adjust the vertical position of the lower subframe 298. As with the conveyor 44, the vertical adjustment of the lower subframe 298 is to accommodate partitions of different heights.

Mounted to the upper supframe 296 is an upper track 310, and mounted to the lower subframe 298 is a lower track 312. The tracks 310 and 312 have opposing U-shaped buckets 314 defining vertical slots 316 into which the partitions are inserted by the collapser 22.

Figures 19, 20:
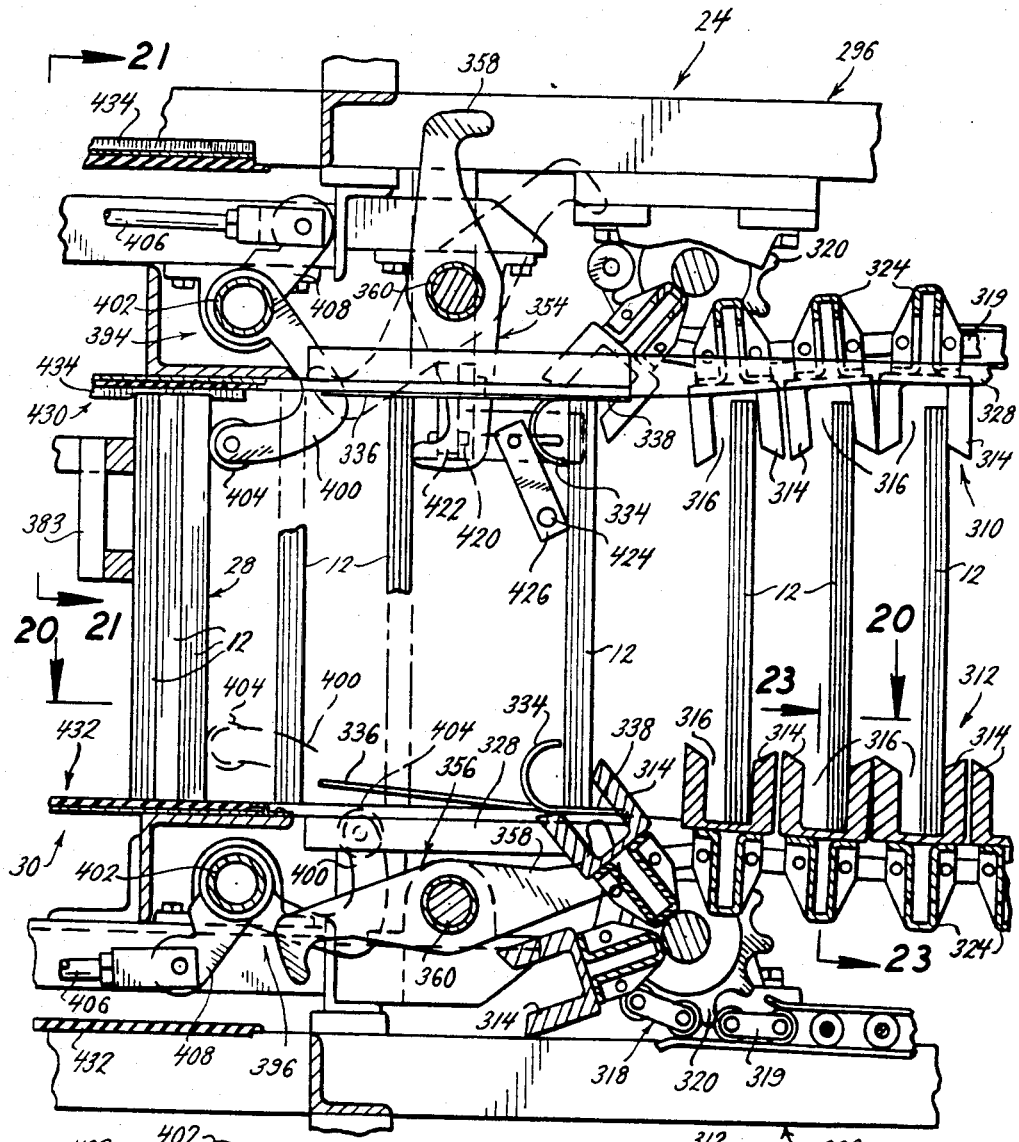
FIG. 19 is an enlarged view in section taken generally along the line 19—19 of FIG. 15 and showing the transfer mechanism.
FIG. 20 is a view in section taken generally along the line 20—20 of FIG. 19.

More specifically, the tracks 310 and 312 are essentially identical with each including longitudinally spaced parallel chain and sprocket drives 317 (FIGS. 16 and 17) and 318 (FIGS. 17 and 19). Thus, each of the chain drives 317 and 318 includes a continuous chain 319 driven by sprockets 320, the sprockets of the upper track 310 being mounted to the upper subframe, and the sprockets of the lower track 312 being mounted to the lower subframe.

Figures 21, 22, 23, 24:
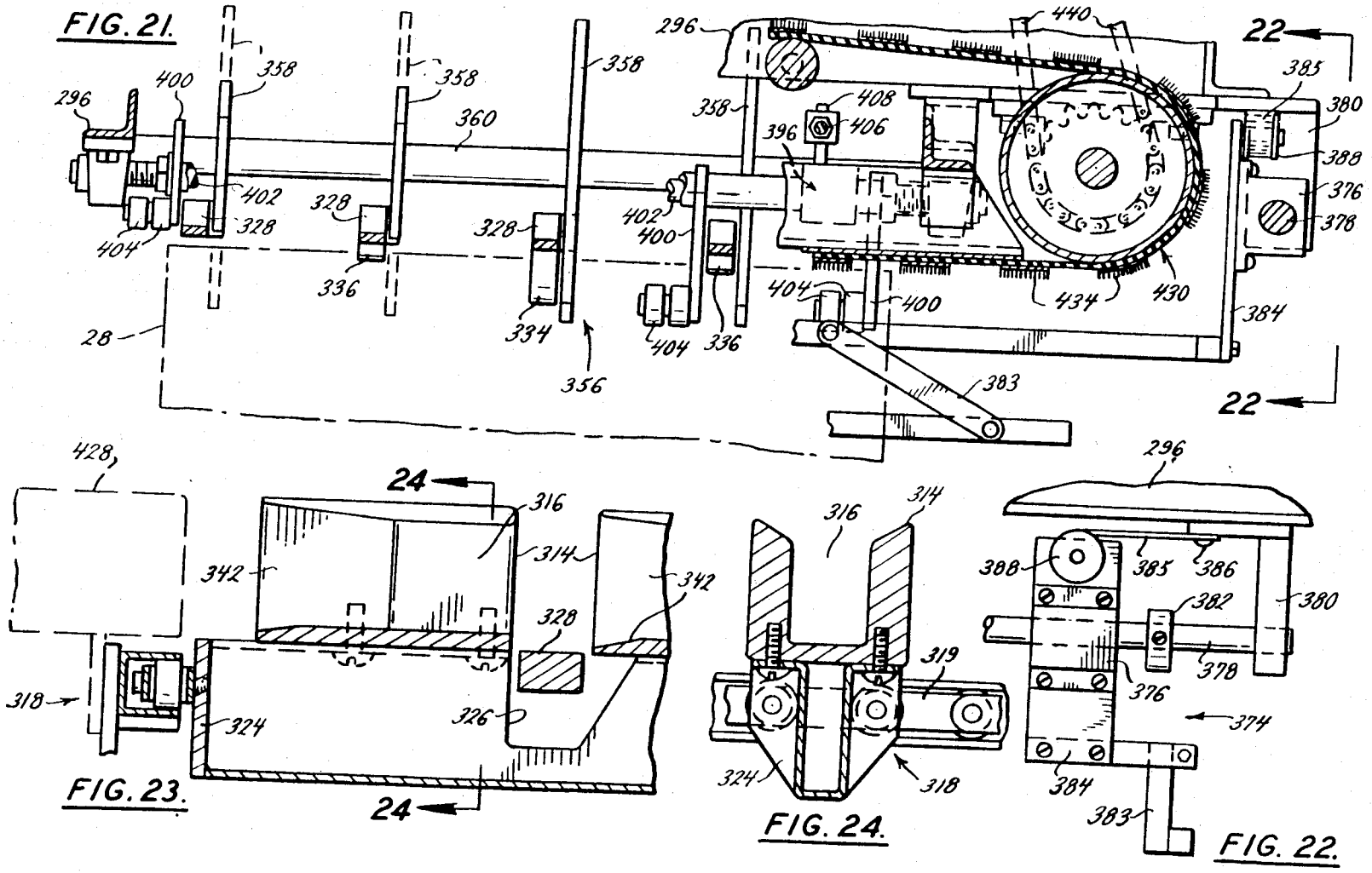
FIG. 21 is a view in section taken generally along the line 21—21 of FIG. 19.
FIG. 22 is a view in section taken generally along the line 22—22 of FIG. 21.
FIG. 23 is an enlarged view in section taken generally along the line 23—23 of FIG. 19.
FIG. 24 is a view in section taken generally along the line 24—24 of FIG. 23.
Figures 26, 27:
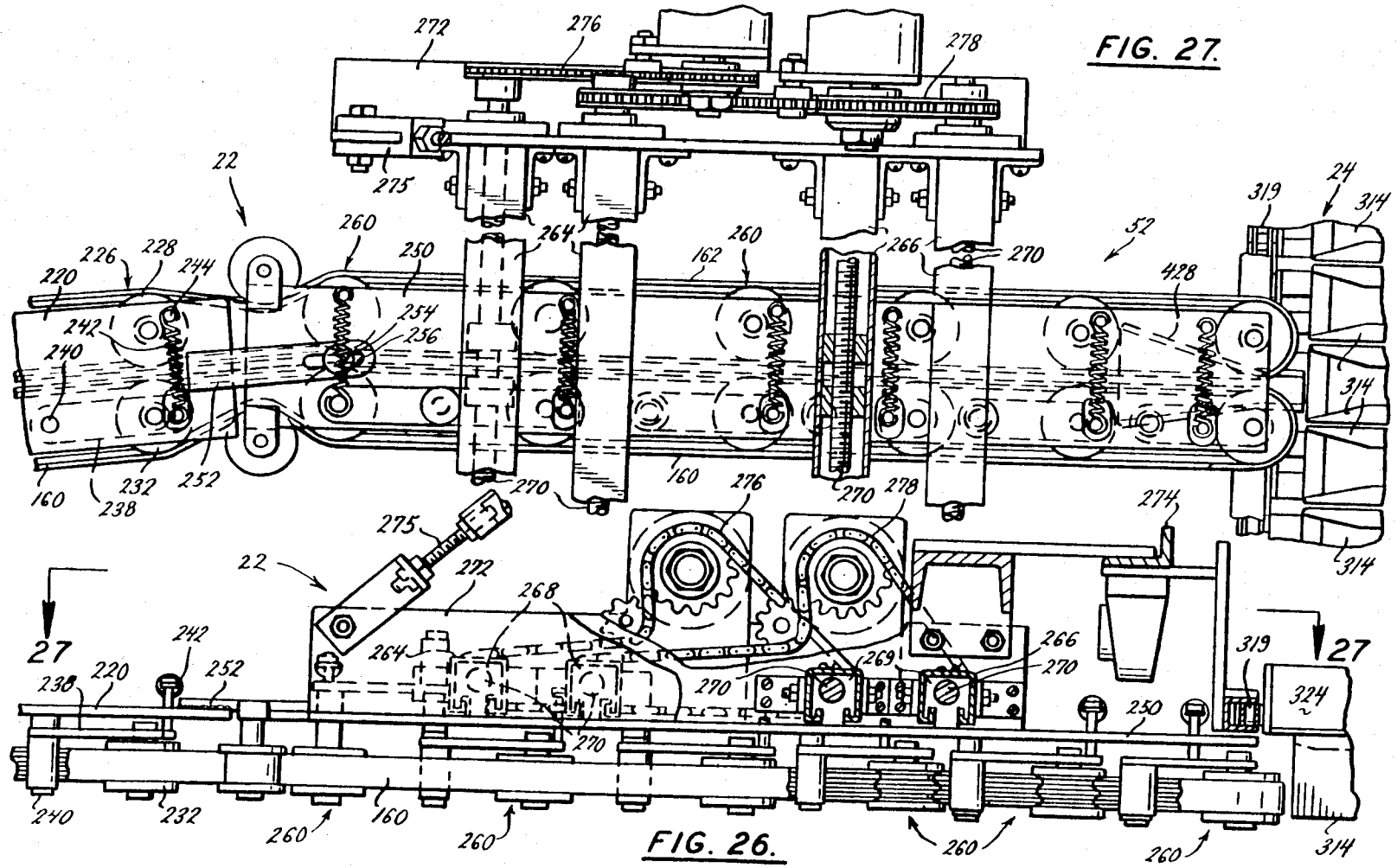
FIG. 26 is a view in section taken generally along the line 26—26 of FIG. 25.
FIG. 27 is a view in section taken generally along the line 27—27 of FIG. 26.

Rather than standard chain links, the chains 319 include channel members 324 (FIGS. 19, 23 and 24). The channel members 324 form part of the chain linkage and extend longitudinally between the parallel chain drives 317 and 318 of each of the upper and lower tracks 310 and 312. The U-shaped buckets 314 are secured to the tops of the channels. As shown in FIGS. 20 and 23, the channel members have transversely aligned generally U-shaped slots 326 which receive transverse bars 328. In this described embodiment there are five such slots 326 spaced along the length of each channel member 324 to receive five such transverse bars 328. The ends of each bar 328 are secured to the upper or lower subframe 296 or 298, as appropriate. Near the left end of each of the upper and lower central bars 328 (as viewed in FIG. 18) is a half coil spring 334, and near the left end of each of the upper and lower bars 328 on either side of the central bars is leaf spring 336 which is mounted to the bar 328 at the location 338.

With reference to FIG. 19, the purpose of the springs 334 is to prevent the partitions 12 from falling once they are moved to the left, beyond the paths of movement of the buckets 314, as they are fed from the tracks toward the conveyor 30. The springs 334 will bow downwardly and to the left to permit each succeeding partition 12 to move between, and to be held against falling by, them; and also to permit each partition to move beyond them as further partitions move that partition to the left to become part of a bundle. The purpose of the leaf springs 336 is to hold the partitions 12 of a bundle in an upright position by applying slight pressure at the bottom and top edges of the partitions, as they are moved laterally toward the conveyor 30. In referring to FIG. 19, it will be noted that the upper spring 336 is shown compressed by the partition 12 for purposes of illustration.

Figure 18:
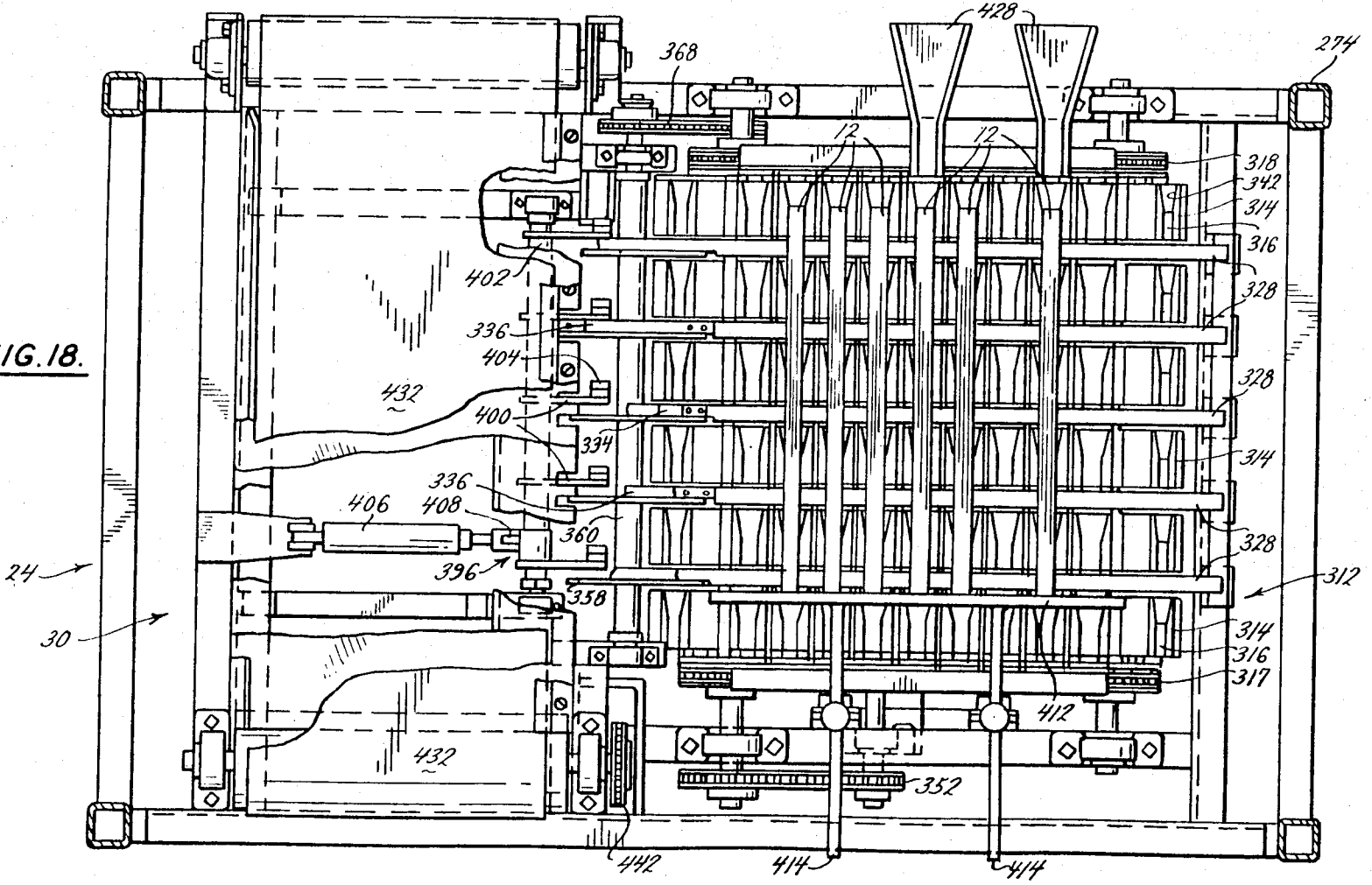
FIG. 18 is an enlarged view in section taken generally along the line 18—18 of FIG. 16.

With reference to FIG. 18, it will be noted that in this described embodiment there are six U-shaped members 314 mounted in longitudinal alignment at the top of each channel member 324. The lengths of the channel members 324 and the number of aligned buckets 314 determines the maximum length of partitions that can be processed by the machine. In other words, the total length of each slot 316 is defined by the overall length of the longitudinally aligned U-shaped buckets.

As seen from FIGS. 18 and 23, each of the buckets is tapered at its leading edges 342 to ensure ease of entry of the partition into the slots 316.

The upper track 310 and lower track 312 are driven by electric pulse operated vacuum clutch drives 346 and 348 through sprocket and chain drives 350 and 352 respectively. These clutch drives are well known in the art and are such that they advance the tracks 310 and 312 a predetermined amount upon receiving a start pulse. The amount of indexing or advancing of the tracks is adjustable and is determined by a slotted disc and sensor which may be within the drive itself. As viewed in FIG. 16, the upper track is driven clockwise and the lower track counterclockwise to move the partitions which are inserted into the slots 316 from the collapser transversely to the left.

Near the output, or left, end of the tracks are upper and lower flipper assemblies 354 and 356 (FIGS. 19, 20, or 21). Each flipper assembly has longitudinally spaced flipper members 358 mounted on a longitudinal shaft 360. The shaft 360 for the upper flipper assembly is journaled at each end in the upper subframe 296, and the shaft 360 for the lower flipper assembly is journaled at each end to the lower subframe 298. The shafts 360 of the upper and lower flipper assemblies are driven by electric pulse operated vacuum clutch drives 362 and 364 through chain and sprocket drives 366 and 368. The clutch drives 362 and 364 operate in the same way as the clutch drives 346 and 348 in that they rotatably drive the shafts 360, and hence the flippers 358, a selected predetermined amount for each electric pulse delivered to the drive.

The purpose for the flippers 358 is to engage the bundle after it is formed and move it toward and onto the conveyor 30. It will be noted that in this described embodiment there are five such flippers spaced along each of the shafts 360 of the upper and lower flipper assemblies 354 and 356.

In FIG. 19 the upper and lower flippers 358 are shown in different positions by solid and dashed lines. It is to be understood that at a given instant of time, all of the upper and lower flippers are at the same position so that the bundle is moved as a unit transversely toward the conveyor section. To facilitate a clear showing of the normal and moved positions of the flippers 358 in FIG. 19, only the righthand-most of the partitions of a bundle, being moved to the left by those flippers, is shown.

So that the partition bundle remains supported as the partitions are accumulated from the slots, a spring biased slide bar assembly 374 has blocks 376 at the fore and aft ends thereof slidingly mounted on transverse rods 378 mounted at their ends to brackets 380 of the upper subframe 296. The rods have stops 382 to limit the transverse movement of the blocks. A parallelogram support 383 is mounted at the lower ends of plates 384, secured to the blocks, to rest against the outer surface of the partition bundle as it is formed and moved transversely onto the conveyor. The blocks 376, and hence the support 383, are spring biased against the bundle by means of negator springs 385 each having one end attached to a bracket 380 at 386 and the other end coiled onto a spool 388 secured to the block 376 by means of the plate 384.

Thus, with particular reference to FIG. 16, the extreme transverse positions of the support assembly 374 are shown by solid and dashed lines, with the bundle support 383 being forced to the left as more partitions are added to the bundle.

Once the bundle is assembled, i.e., once it has the preselected number of partitions in it, the entire bundle is pushed into the conveyor section first by the upper and lower flipper assemblies 354 and 356 as previously described and then further by upper and lower pusher assemblies 394 and 396. Each of these pusher assemblies has a plurality of pusher arms 400 spaced along a shaft 402. In this preferred embodiment there are five such pusher arms spaced along each of the upper and lower shafts. Each pusher arm has rollers 404 at the ends thereof for engagement with the bundles. The shaft 402 of the upper pusher assembly is journaled at its ends in the upper subframe 296, and the shaft of the lower pusher assembly is journaled in the lower subframe 298. The shafts 402 are made to rotate through operation of electrically operated cylinders 406 through a linkage 408. Hence, by extension of the cylinder/pistons 406, the shafts 402 are made to rotate and the pusher arms 400 made to engage and push the entire bundle further into the conveyor section (to the left as viewed in FIGS. 16, 18, and 19).

The depth of the slots 316 is effectively adjusted by a transverse stop bar 412 mounted at the ends of longitudinal parallel rods 414. The rods 414 are adjustably secured at the top of mounting posts 416 (FIG. 18) which are vertically adjustable. Hence, the stop bar 412 may be adjusted both vertically and longitudinally for proper slot depth and partition engagement.

An electric eye 420 is adjustably mounted in a suitable bracket 422 to detect when the partitions are fully within the slots 316 as will be further explained. Another electric eye 424 and counter 426 (see FIG. 36) counts the partitions as they are fed to the bundle, which will also be further described.

Guides 428 (FIGS. 17, 18 and 27) are located at the input to the slots 316 to guide the partitions into the slots. The guides are mounted to the lower subframe 298 for transverse adjustment.

Figures 36, 37:
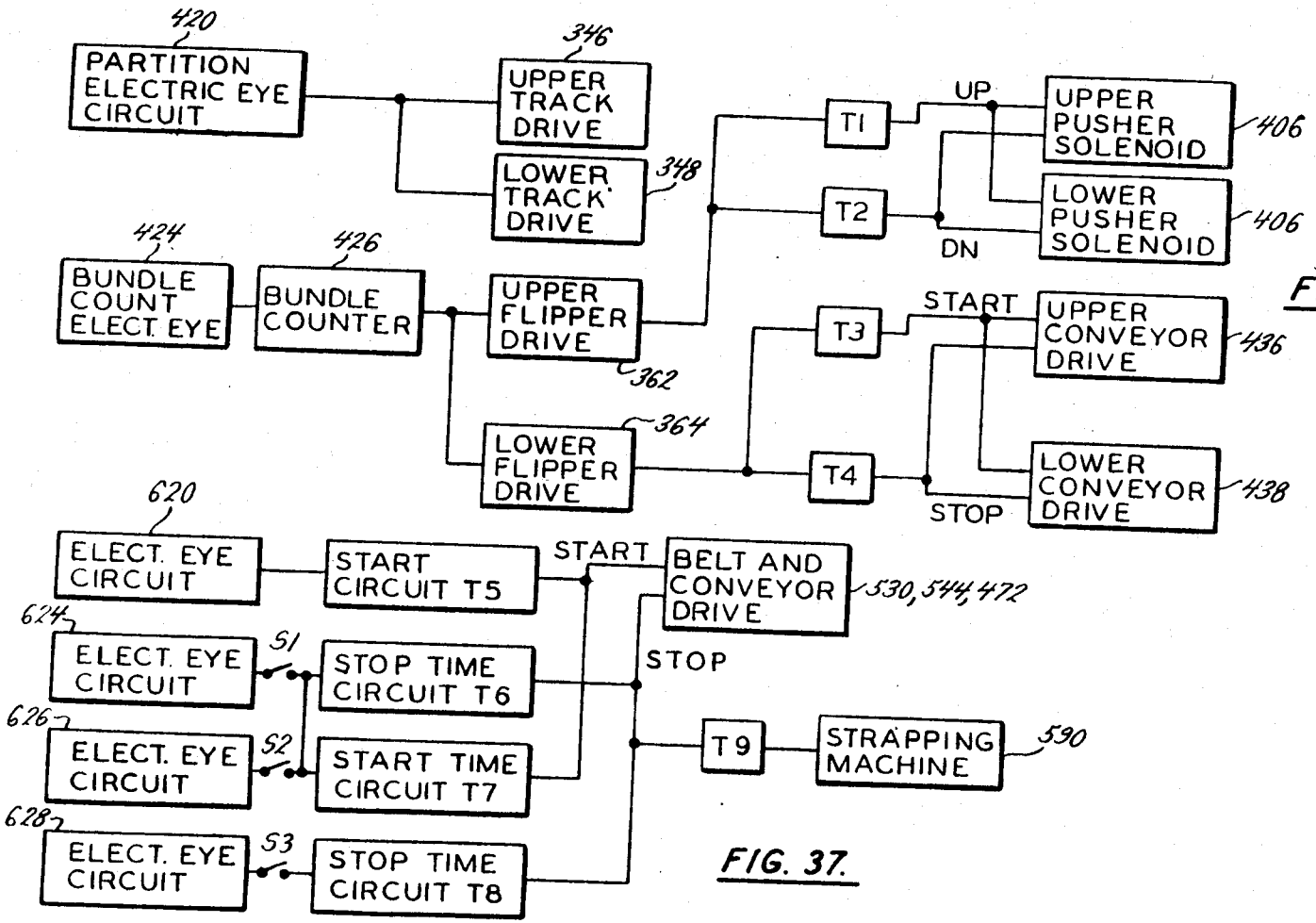
FIG. 36 is an electrical block diagram of a control circuit for the collector portion.
FIG. 37 is an electrical block diagram of a control circuit for the strapper portion.

The conveyor section 30 includes an upper conveyor 430 and a lower conveyor 432. The upper conveyor is mounted to the upper subframe 296, and the lower conveyor is mounted to the lower subframe 298, and is therefore vertically adjustable along with the lower track assembly. The upper conveyor belt has transverse pads 434, which may be brushes of nylon or the like, which grip the upper edges of the partitions and bundle so that operation of the conveyors moves the bundle toward the strapping section. The upper and lower conveyors are driven by pulse operated vacuum clutch drives 436 and 438 through chain and sprocket drives 440 and 442. These clutch drives operate the conveyors for a time duration determined by a timing network which is part of the control circuit (FIG. 36).

Strapper Section

With reference to FIGS. 28 through 32, the strapper section 32 will be described. The purpose of the strapper is to apply straps 460 to the bundle 28 to hold the bundle together. Like the other sections of the apparatus, the strapper machine must be vertically adjustable, and must be further adjustable to accommodate bundles of various lengths and thicknesses.

Figures 28, 29:
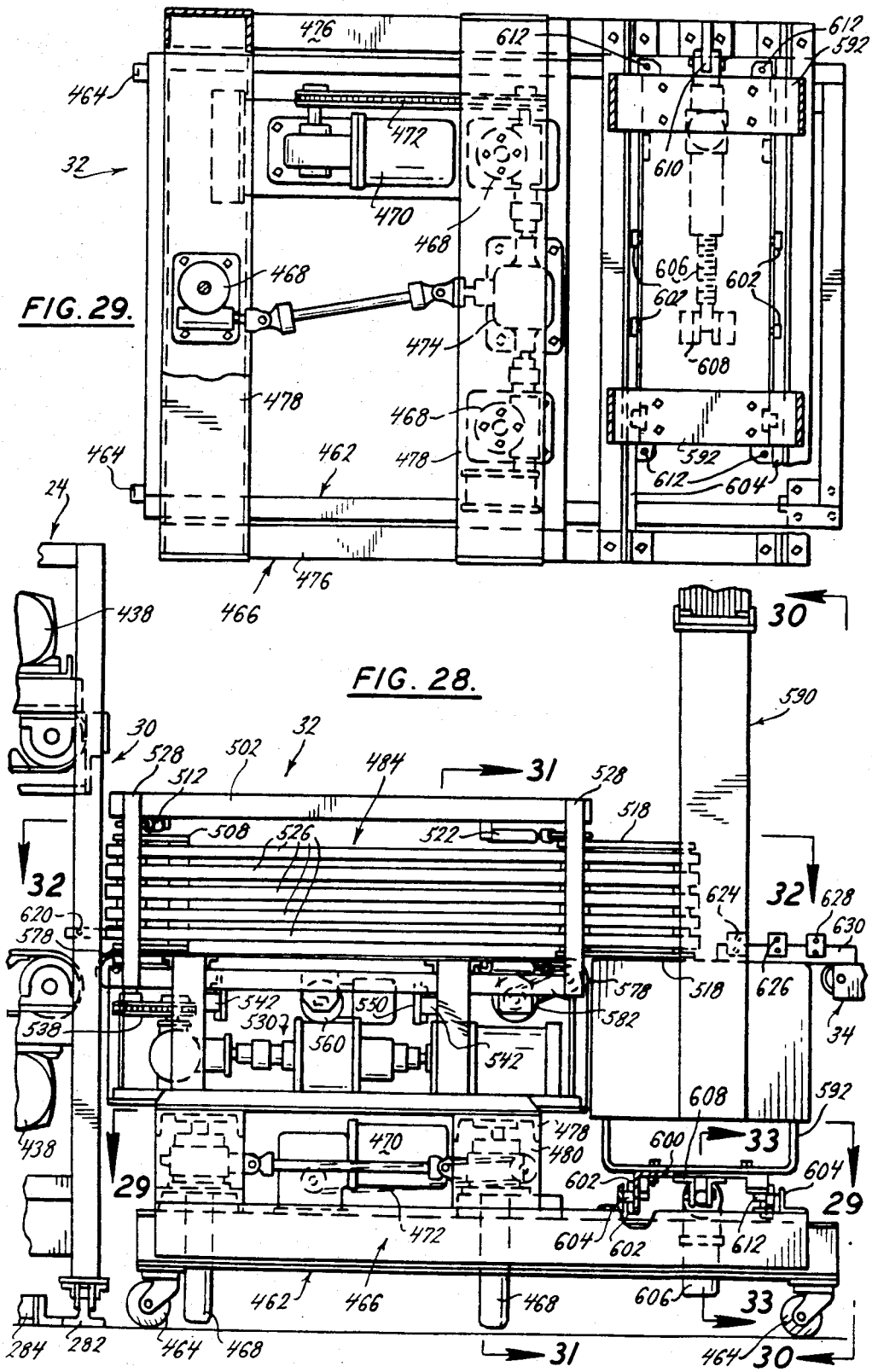
FIG. 28 is a right side elevation of the strapper assembly portion as viewed upstream of the apparatus.
FIG. 29 is a view in section taken generally along the line 29—29 of FIG. 28.

The strapper machine 32 includes a main rectangular frame 462 supported on the floor by casters 464. A vertically adjustable frame 466 is mounted on the main frame by motor jacks 468 (FIGS. 28 to 30) which are in a tripod arrangement and which are driven from a motor 470 through a chain drive 472 and gear box 474 as best shown in FIG. 29. The adjustable frame 466 has parallel longitudinal beams 476 at its lower end and transverse beams 478 spaced above the beams 476 by vertical supports 480. The motor jacks 468 are mounted between the main frame 462 and the transverse beams 478.

Figure 32:
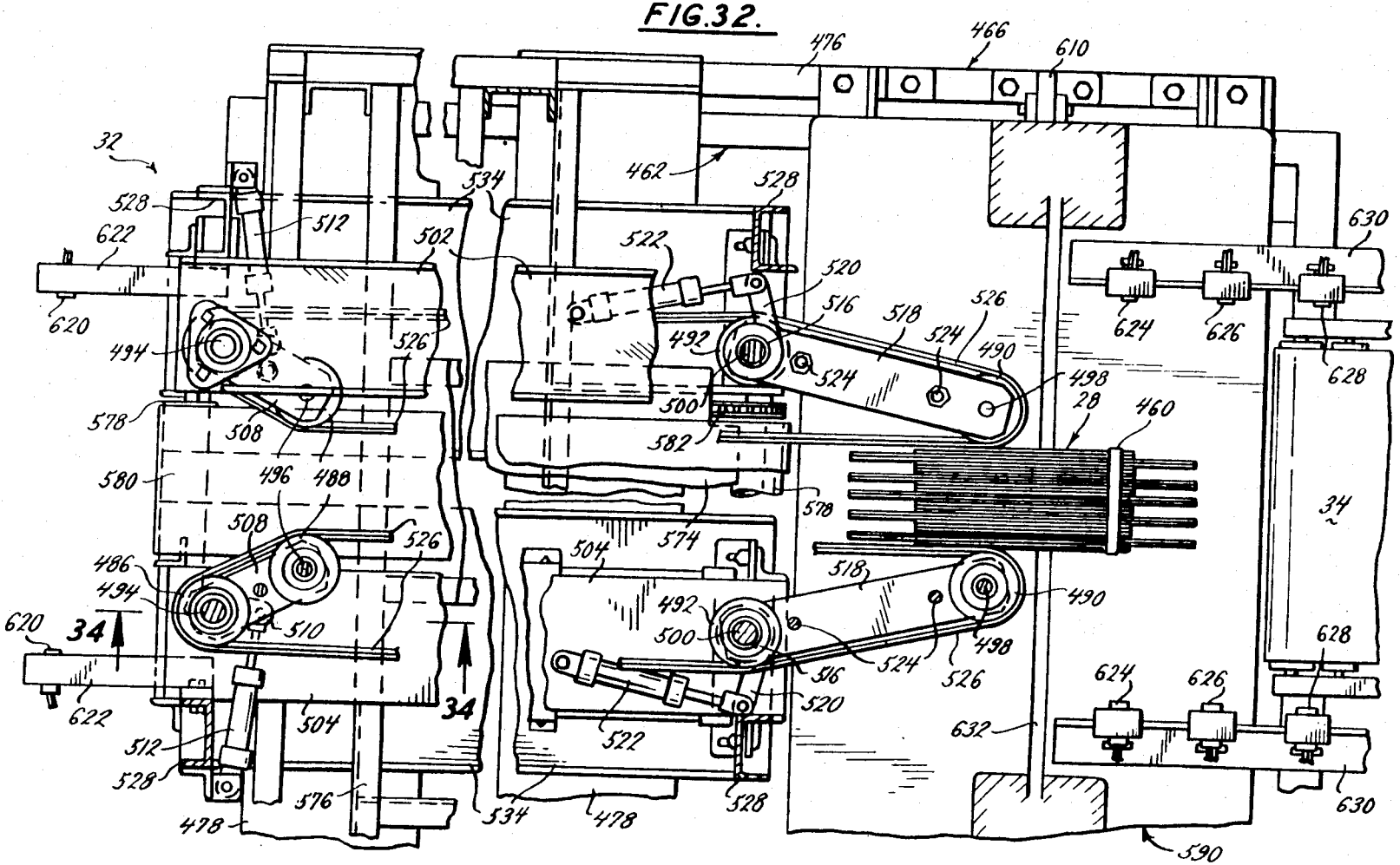
FIG. 32 is an enlarged broken view in section taken generally along the line 32—32 of FIG. 28.

Vertical belt drives 482 and 484 are mounted to the adjustable frame 466 at the upper end thereof. The belt drives are identical except that the drive 482 is fixed transversely relative the adjustable frame, while the drive 484 is transversely adjustable relative the frame to accommodate bundles of various thicknesses. Each belt drive has multiple belt pulleys 486, 488, 490 and 492 mounted on shafts 494, 496, 498 and 500 respectively (FIG. 32). In this described embodiment, the pulleys are shown to be of the five belt type, although pulleys of fewer or greater numbers of belts could be used as required. With respect to each belt drive, the shaft 494 is journaled at its top end to a longitudinal beam 502 and at its bottom end to a longitudinal beam 504. With particular reference to FIGS. 32, 34 and 35, above and beneath the pulley 486 and surrounding the shaft 494 are upper and lower sleeves 506 having arms 508 extending radially therefrom. The shaft 496 of the pulley 488 is vertically mounted near the ends of the arms 508. Other arms 510 extend from the sleeves, and air cylinder/pistons 512 have one end connected to the arms 510 and the other end connected to the adjustable frame 466. It can be seen that by extension of the air cylinder/-pistons 512, the sleeves 506 are made to rotate relative the shaft 494 causing the pulley 488 to swing on the arms 508. A tie rod 514 extends between the arms 508.

The mounting of the shafts 500 and 498 are very similar to the shafts 494 and 496, respectively. Thus, the shaft 500 is journaled between the beams 502 and 504 and has upper and lower sleeves 516 with arms 518 and 520 extending therefrom. The arms 518 are similar to the arms 508 but are longer. The shaft 498 is vertically mounted near the ends of the upper and lower arms 518. Air cylinders/pistons 522 have their piston ends connected to the arms 520 and their other ends connected to the adjustable frame 466. Thus, the cylinder/pistons 522 bias the arms 518 and thus the pulleys 490 toward each other as shown in FIG. 32. Suitable tie rods 524 extend between the upper and lower arms 518. Drive belts 526 extend around the pulleys 486, 488, 490 and 492 of each of the belt drives 482 and 484.

Each belt drive 482 and 484 is mounted to the adjustable frame 466 through vertical frame members 528 connected between the parallel longitudinal beams 502 and 504. A motor drive 530 for each belt drive is supported on a hanger assembly 532 suspended from the beam 504. The hanger assembly 532 has a base beam 534 suspended from the beam 504 by vertical members 536. Each motor drive 530 is supported on a base beam 534, and drives a shaft 494 of a pulley 486 through a chain drive 538.

The belt drive 482 is secured to the adjustable frame 466 in fixed transverse relation through connection of the hanger assembly 532 of the belt drive 482 to parallel transverse tracks 542 which are secured to the frame 466.

Figure 31:
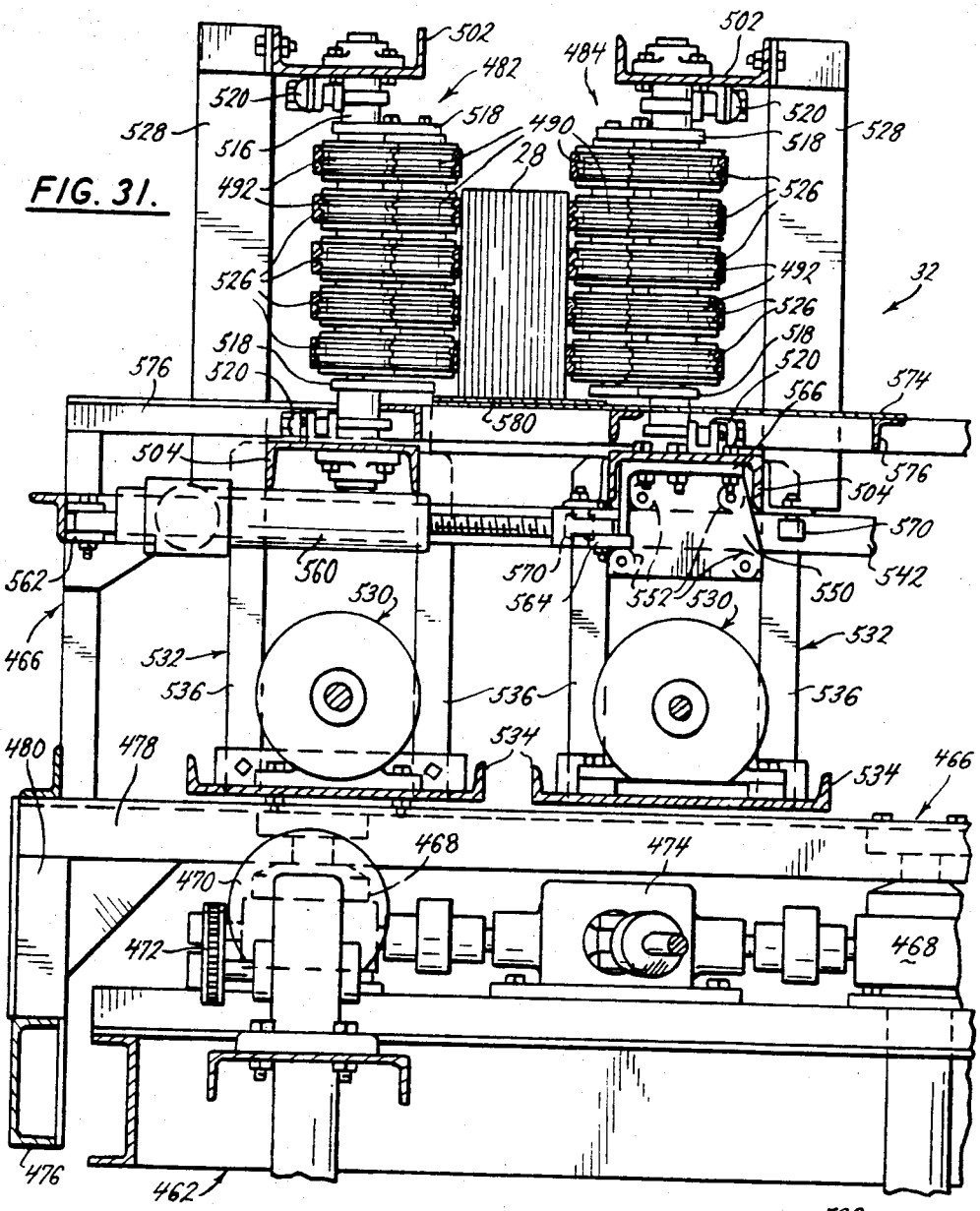
FIG. 31 is an enlarged view in section taken generally along the line 31—31 of FIG. 28.

The belt drive 484 is mounted to the tracks 542 for transverse adjustment. Plates 550 are secured to the beam 504 of the belt drive 484 and have rollers 552 that ride above and below the tracks (FIGS. 31 and 34). A motorized screw jack 560 has one end connected at 562 to the adjustable frame 466, and the lead screw end connected at 564 to a bracket 566 secured to the beam 504. Additional rollers 570 are mounted to the beam 504 for engagement with the sides of the tracks 542 to ensure smooth operation.

Thus, it can be seen that by operation of the screw jack 560, the entire belt drive 484, including its vertical frame members 528, hanger assembly 532, and motor drive 530, is adjustable as a unit transversely along the tracks 542 to accommodate bundles of various widths.

At the base of the belt drives 482 and 484, is a plate 574 on angle bars 576 which are part of the adjustable frame 466. At the fore and aft ends of the plate 574 are rollers 578 about which a conveyor belt 580 extends. The rollers are mounted to the frame 466 about transverse axes. The conveyor 580 is driven by a motor and chain drive 582 similar to the motor and chain drive 530, 538. Alternatively, the conveyor is driven from the motor and chain drive 530, 538 of the fixed belt drive 482.

A strapping device 590 is located at the downstream end of the belt drives 482 and 484 and is mounted on the lower longitudinal beams 476 of the adjustable frame 466. The strapping device 490 may be of any suitable type such as, for example, a SIGNODE model ML-1-EE, manufactured by the Signode Corporation of Chicago, Ill.

In this preferred embodiment of the invention, the strapping device 590 is mounted for transverse adjustment relative the adjustable frame 466, and hence relative the belt drives 482 and 484, so that it may be properly aligned with the bundle as it enters the strapping device from the belt drives and conveyor.

Figure 33:
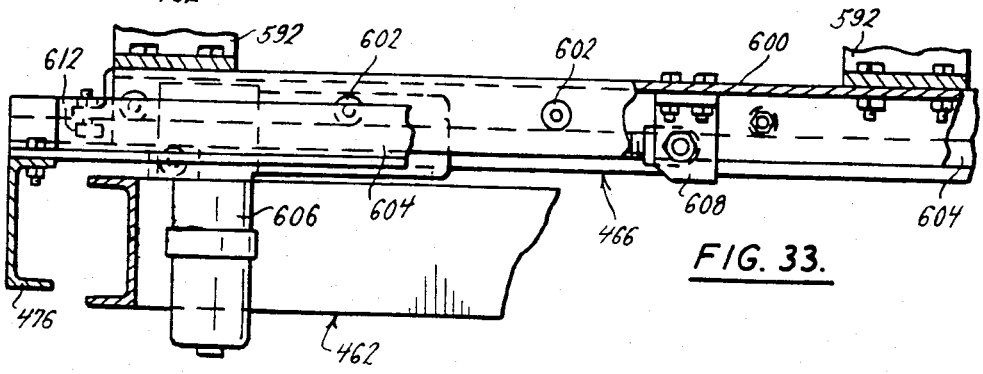
FIG. 33 is an enlarged view in section taken generally along the line 33—33 of FIG. 28.

Hence, the lower end of the strapping device 590 has brackets 592 to which is secured a transverse channel member 600. Rollers 602 are mounted to the channel member and ride on transverse rails 604. A screw jack 606 has its lead screw end connected to channel member 600 by a bracket 608 (FIGS. 28, 29 and 33), and its other end connected to a side frame member 476 by a bracket 610. Rollers 612 are at the ends of the channel member 600 and ride along the sides of the rails to ensure smooth operation. Hence, by operating the power screw jack 606, the transverse position of the strapping device 590 can be adjusted.

With reference to FIGS. 28 and 32, at the upstream end of the strapping machine 32, is an electric eye 620 for detecting the presence of a bundle as it enters the strapping machine and engaging the conveyor and belt drives. The electric eye 620 is mounted on arms 622 extending forwardly from the adjustable frame 466 on either side of the belt drives.

At the downstream end of the belt drives, are electric eyes 624, 626 and 628 mounted for longitudinal adjustment on arms 630. Each of the electric eyes 624, 626 and 628 is longitudinally adjustable relative to the strapping location 632 to detect the presence of the bundle, deactivate the conveyor and belt drives, and activate the strapping device 590 to place a strap around the bundle at a preselected location. In this described embodiment, there are three such electric eyes shown so that there will be three straps placed about the bundle at longitudinally spaced locations. A fewer or greater number of electric eyes can be used for the number of straps required.

Operation

Operation of individual portions of the collapser/collector sections has been described. The overall operation of the apparatus of this invention will be described with further reference to the electrical block diagrams of FIGS. 36 and 37.

By way of overall operation, the various vertical, longitudinal, and transverse adjustments are made for proper alignment of the machine and to accommodate the size of the partitions being produced, all as previously described. The assembled partitions from the assembler 20 are fed through the collapser section first by means of the conveyor 44 and belt drive 70. During this portion of their travel, the partitions are made to collapse to a generally flat, vertically oriented configuration due to the engagement of the top and side edges of the cross partition strips by the belt drive 70 and guide or rail 100, which converges toward the path of travel of the partitions. As the partitions move further down the feed lines 50 and 52, they are gripped at their upper ends by the bands 160 and 162. After leaving the conveyor 44 they are conveyed by the bands 160 and 162, by means of the spring biased roller pairs, through the intermediate section 62 and into the in-feed section 64. From the in-feed section, they are fed into slots 316 in the collector section.

At the time the partitions 12 are fed into the slots 316, the upper and lower tracks 310 and 312 of the collector are stationary, and two of the slots are aligned with the guides 428. When the partitions are fully inserted into the slots, this is detected by the electric eye circuit 420, whereupon a signal is sent to the pulse drives of the upper and lower tracks to drive the tracks a defined distance, and thus index or advance the partitions toward the conveyor section 30 after which the track drives disengage. Upon disengagement of the track drives, a new set of slots becomes aligned with the in-feed section so that the next pair of collapsed partitions are fed into these new empty slots. This again is detected by the electric eye circuit 420 and the tracks again advance as before. Where, as in this embodiment, there are two partitions processed simultaneously, the in-feed sections are spaced to leave two empty slots between those in which the partitions are inserted. By then driving the tracks to index the slots two positions over, there will always be two empty slots presented to the next pair of partitions. If three partitions are processed simultaneously, the spacing leaves one empty slot between those in which the partitions are inserted and the tracks are indexed three positions. If four partitions are processed simultaneously, the spacing leaves one empty slot between the first and second slots in which partitions are inserted, two empty slots between the second and third slots in which partitions are inserted, and one empty slot between the third and fourth slots in which partitions are inserted, and the tracks are indexed four positions. A greater number of empty slots between those in which partitions are inserted may be provided and may be desirable.

As the partitions leave the tracks and are moved into a bundle while maintaining their generally vertical orientation, they are counted by the electric eye circuit 424 and bundle counter circuit 426. Upon a predetermined count, the counter circuit 426 sends a signal to the upper and lower flipper drives 362 and 364 to actuate the flipper assemblies 354 and 356 causing the flippers to rotate 180° and push the bundle further between the upper and lower conveyors 430 and 432. Upon actuation of the flipper drives, a signal is sent to suitable timers $T_1$ and $T_2$ which set the time delay between operation of the flipper assemblies and operation of the pusher assemblies, as well as the length of time the pusher assemblies remain actuated. Thus, timer $T_1$ sends a signal to the upper and lower pusher solenoids 406 causing the pushers to actuate, and timer $T_2$ sends a signal to the pusher solenoids causing the pushers to deactuate. This ensures that the entire bundle is pushed completely into the conveyor section 30.

Also, upon actuation of the flipper drives, a signal is sent to suitable timers $T_3$ and $T_4$ which set the delay between operation of the flipper assemblies and actuation and deactuation of the upper and lower conveyor drives 436 and 438. Thus, the timer $T_3$ is set to actuate the conveyor drives after the pushers are actuated, and $T_4$ is set to deactuate the conveyor drives after a time interval which allows the conveyors 430 and 432 to convey each bundle to the strapping section.

The operation of the strapping section will be described with reference to FIG. 37. The leading edge of a bundle is sensed by the electric eye circuit 620 which sends a signal to a start timing circuit $T_5$ which in turn sends a signal to engage or start the belt and conveyor drives 530, 544, 472. With these drives engaged, the bundle is conveyed by the conveyor 580, and gripped and conveyed by the belt drives 482 and 484 toward the strapping device 590. As shown by FIG. 32, the bundle is thicker at its center than at its ends due to the composition of the partitions. The biased arms 508 and 518 provide a positive gripping of the bundle, although its thickness varies over its length. Thus, the opposing arms 508 and the opposing arms 518 are biased toward each other to grip the thinner portions of the bundle and yet are allowed to separate as the thicker portions of the bundle pass therebetween. While two arms, fore and aft, are shown with each belt drive, a greater number of arms could be provided as required to ensure positive gripping of the bundle to move it into the strapping device.

When the leading edge of the bundle is detected by the first of the electric eye circuits 624, and with switch $S_1$ closed, a signal is sent to a stop timing circuit $T_6$ which in turn sends a signal to stop the conveyor and belt drives. A signal is also sent to a timing circuit $T_9$ which in turn sends a signal to the strapping machine 590 actuating that machine to place a strap around the bundle. The electric eye circuit 624 also sends a signal to a start timing circuit $T_7$ which sends a signal to start the conveyor and belt drives. By way of example, the timing circuit $T_6$ may be 0.05 seconds, the timing circuit $T_9$ may be 0.5 seconds, and timing circuit $T_7$ may be 1.5 seconds. Thus, when the leading edge of the bundle is detected, the drives are disengaged, then a strap is placed around the bundle, and then the drives are engaged.

When the leading edge of the bundle is detected by the second electric eye circuit 626, and with switch $S_2$ closed, a signal is again sent to the stop and start timing circuits $T_6$ and $T_7$ and the timing circuit $T_9$ to again disengage the drives, place the strap on the bundle, and re-engage the drives. When the leading edge of the bundle is detected by the last electric eye circuit 628, and with switch $S_3$ closed, a signal is sent to a stop timing circuit $T_8$ which sends the signal to disengage the drives and thereafter place a third strap on the bundle. In this described embodiment, the drives then remain disengaged until the next bundle is detected by the electric eye circuit 620 whereupon the process repeats. Selected ones of the electric eye circuits can be disengaged by opening the appropriate switches $S_1$, $S_2$, and $S_3$ to select the number of straps to be applied to each bundle.

All of the drives are preferably variable speed so that the apparatus can be operated at different speeds. Merely by way of example, the apparatus may be adjusted to run at approximately 100 partitions per minute per feed line. Assuming two feed lines, and forty partitions per bundle, this is a speed of five bundles per minute. This is by way of example only, as the drive speed can be faster or slower and there can be a greater or fewer number of feed lines.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

We claim:

1. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions.

2. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, and means for collecting each collapsed partition adjacent the end of said predetermined path and moving it in its generally vertical orientation along a path generally normal to said predetermined path to be grouped with other collapsed partitions to form a bundle.

3. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, means for collecting each collapsed partition adjacent the end of said predetermined path and moving it in its generally vertical orientation along a path generally normal to said predetermined path to be grouped with other collapsed partitions to form a bundle, and means for holding bundles of collapsed partitions with the collapsed partitions thereof generally vertical while a strapping means straps the bundles to hold said assembled partitions of each bundle together.

4. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, part of said collapsing means being an engaging means which engages only a small fraction of an edge of each of those partition strips of said assembled partitions which extend transversely of said predetermined path, and the engagements between said engaging means and said small fractions of said edges of said transversely-extending partition strips enabling said transversely-extending partition strips to shift toward said predetermined path as said assembled partitions are collapsed while continuing to be held generally-vertical as they are moved along said predetermined path.

5. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, said collapsing means further comprising means for engaging each assembled partition at a location along said predetermined path, and said engaging means responding to forward movement of each assembled partition along said predetermined path to shift at least one of the partition strips of each assembled partition toward said predetermined path without interrupting the forward movement of said assembled partition along said predetermined path, and thereby initiating collapsing of each assembled partition as it is conveyed forwardly along said predetermined path in substantiallyuninterrupted manner.

6. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, said collapsing means further comprising means for engaging each assembled partition at a location along said predetermined path, said engaging means responding to forward movement of each assembled partition along said predetermined path to shift at least one of the partition strips of each assembled partition toward said predetermined path, without interrupting the forward movement of said assembled partition along said predetermined path, and thereby initiating collapsing of each assembled partition as it is conveyed forwardly along said predetermined path in substantiallyuninterrupted manner, and further comprising means for adjusting the position of said partition-engaging means along said predetermined path to adjust the location of engagement between assembled partitions and said partition-engaging means to accommodate assembled partitions of various lengths.

7. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, and said collapsing means further comprising adjustment means for adjusting the spacing between portions of said collapsing means for accommodating assembled partitions of various heights and widths.

8. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, each assembled partition having longitudinal and cross partition strips, said collapsing means having drive means engaging the top edges of the cross partition strips, and further comprising a guide means, said guide means converging downstream relative to said predetermined path, said guide means engaging the side edges of said cross strips, whereby said assembled partitions are collapsed to a generally flat vertical orientation by said engagements of said drive means and guide means.

9. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, and said collapsing means engaging said collapsed partitions to hold said collapsed partitions suspended in said generally vertical configuration while said collapsing means move said collapsed partitions.

10. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, said predetermined path having its maximum width where said assembled partitions are caused to enter said path, and a part of said predetermined path being so narrow that a partition must be in a collapsed condition to pass through it.

11. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, said predetermined path having a width that is smaller than the length of the longest partition strip of any of said assembled partition, said collapsing means including driven bands, and biasing means biasing said bands into gripping engagement with said partitions.

12. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, said collapsing means further comprises means for engaging each assembled partition at a location along said predetermined path to start the collapsing of each assembled partition, and means for progressively completing the collapsing of each assembled partition after engagement with said engaging means but prior to said bundling of said assembled partitions as said assembled partition is conveyed along said predetermined path, said engaging means being adjustable relative to said predetermined path.

13. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, said collapsing means applying some of said positive advancing forces to the upper edges of the transversely-directed partition strips of said partitions, said some positive advancing forces being applied to just small fractions of the lengths of said upper edges of said transversely-directed partition strips, and said small fractions of the lengths of said upper edges of said transversely-directed partition strips being adjacent the midpoints of said upper edges of said transversely-directed partition strips, whereby the edges of said transversely-directed partitions strips need move only short distances to approach said predetermined path.

14. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, said collapsing means further comprising means for engaging each assembled partition at a location along said predetermined path, said engaging means responding to forward movement of each assembled partition along said predetermined path to shift at least one of the partition strips of each assembled partition toward said predetermined path without interrupting the forward movement of said assembled partition along said predetermined path, and said engaging means momentarily causing part of said one partition strip to move forward at a lesser rate than other partition strips, and thereby initiating collapsing of each assembled partition as it is conveyed forwardly along said predetermined path in substantially-uninterrupted manner.

15. A machine for processing assembled box partitions, said machine comprising means for collapsing the assembled partitions to a flat, generally vertical, configuration prior to the bundling of said assembled partitions to facilitate the subsequent compiling of the collapsed partitions into bundles, said collapsing means moving said assembled partitions along a predetermined path while holding some of the partition strips of each assembled partition generally vertical for substantially rotation-free translating movement along said predetermined path, said collapsing means causing other of the partition strips of each assembled partition to move toward said predetermined path while remaining generally vertical.

16. A machine for processing assembled box partitions, said machind comprising means for collapsing the assembled partitions to a flat, generally vertical, configuration prior to the bundling of said assembled partitions to facilitate the subsequent compiling of the collapsed partitions into bundles, said collapsing means moving said assembled partitions along a predetermined path while holding some of the partition strips of each assembled partition generally vertical for substantially rotation-free translating movement along said predetermined path, said collapsing means causing other of the partition strips of each assembled partition to move toward said predetermined path while remaining generally vertical, said collapsing means including a top engaging means in the form of a driven belt, and said belt continuously driving said assembled partitions as said other partition strips are moved toward said predetermined path.

17. A machine for processing assembled box partitions, said machine comprising means for collapsing the assembled partitions to a flat, generally vertical, configuration prior to the bundling of said assembled partitions to facilitate the subsequent compiling of the collapsed partitions into bundles, said collapsing means moving said assembled partitions along a predetermined path while holding some of the partition strips of each assembled partition generally vertical for substantially rotation-free translating movement along said predetermined path, said collapsing means causing other of the partition strips of each assembled partition to move toward said predetermined path while remaining generally vertical, and further comprising a guide means, said guide means converging downstream relative to said predetermined path, a side of each assembled partition engaging said guide as said assembled partition is conveyed along said predetermined path to collapse said assembled partition.

18. A machine for processing assembled box partitions, said machine comprising means for collapsing the assembled partitions to a generally flat configuration, and means for collecting each collapsed partition and compiling successive pluralities of the collapsed partitions into bundles while holding opposite edges of said collapsed partitions, said collecting means further comprising a plurality of spaced-apart slot means for receiving said opposite edges of said collapsed partitions and holding said collapsed partitions for movement toward a position wherein they can be compiled into bundles, and means for indexing said slot means in a direction generally normal to the plane of each collapsed partition is said slot means to move said collapsed partitions toward said compiling position.

19. A machine for processing assembled box partitions, said machine comprising means for collapsing the assembled partitions to a generally flat configuration, and means for collecting each collapsed partition and compiling successive pluralities of the collapsed partitions into bundles while holding opposite edges of said collapsed partitions, said collecting means further comprising a plurality of spaced-apart slot means for receiving said opposite edges of said collapsed partitions and holding said collapsed partitions for movement toward a position wherein they can be compiled into bundles, and means for indexing said slot means in a direction generally normal to the plane of each collapsed partition in said slot means to move said collapsed partitions toward said compiling position, said collecting means further comprising upper and lower continuous track means having members movable therewith defining said plurality of spaced-apart slot means, and said upper and lower continuous track means being indexed in unison.

20. A machine for processing assembled box partitions, said machine comprising means for collapsing the assembled partitions to a generally flat configuration, and means for collecting each collapsed partition and compiling successive pluralities of the collapsed partitions into bundles while holding opposite edges of said collapsed partitions, said collecting means further comprising a plurality of spaced-apart slot means for receiving said opposite edges of said collapsed partitions and holding said collapsed partitions for movement toward a position wherein they can be compiled into bundles, and means for indexing said slot means in a direction generally normal to the plane of each collapsed partition in said slot means to move said collapsed partitions toward said compiling position, said collecting means further comprising means for supporting the collapsed partitions in a generally vertical orientation as they are received by said slot means, and said collapsed partitions being held in spaced relation as they are moved in said generally normal direction by said indexing of said slot means.

21. A machine for processing assembled box partitions, said machine comprising means for collapsing the assembled partitions to a generally flat configuration, and means for collecting each collapsed partition and compiling successive pluralities of the collapsed partitions into bundles while holding opposite edges of said collapsed partitions, said collecting means further comprising a plurality of spaced-apart slot means for receiving said opposite edges of said collapsed partitions and holding said collapsed partitions for movement toward a position wherein they can be compiled into bundles, and means for indexing said slot means in a direction generally normal to the plane of each collapsed partition in said slot means to move said collapsed partitions toward said compiling position, said collapsed partitions being held in a generally vertical orientation as they are received by said slot means and moved toward said position wherein they can be compiled into bundles, and further comprising means for supporting the partitions in a generally vertical orientation as they are compiled into bundles.

22. A machine for processing assembled box partitions, said machine comprising means for collapsing the assembled partitions to a generally flat configuration, and means for collecting each collapsed partition and compiling successive pluralities of the collapsed partitions into bundles while holding opposite edges of said collapsed partitions, said collecting means further comprising a plurality of spaced-apart slot means for receiving said opposite edges of said collapsed partitions and holding said collapsed partitions for movement toward a position wherein they can be compiled into bundles, and means for indexing said slot means in a direction generally normal to the plane of each collapsed partition in said slot means to move said collapsed partitions toward said compiling position, said collapsed partitions being held in a generally vertical orientation as they are received by said slot means and moved toward said position wherein they can be compiled into bundles, and further comprising means for supporting the partitions in a generally vertical orientation as they are compiled into bundles, said support means for supporting the partitions as they are compiled into bundles further comprising means gripping the partitions at their top and bottom edges upon release from said slot means, and means for supporting the downstream side of the bundle as it is formed.

23. A machine for processing assembled box partitions comprising means for collapsing the assembled partitions to a generally flat configuration, means for collecting each collapsed partition and compiling successive collapsed partitions into bundles, means for supporting the partitions in a generally vertical orientation as they are compiled into bundles, said support means further comprising means gripping the collapsed partitions at their top and bottom edges upon release from said collecting means, means for supporting the downstream side of each bundle as it is formed, said downstream side support means being automatically retracted when a bundle is formed, and means biasing said downstream side support means against said bundle while said bundle is being formed.

24. A machine for processing assembled box partitions comprising means for collapsing the assembled partitions to a generally flat configuration, means for collecting each collapsed partition and compiling successive collapsed partitions into bundles, means for supporting the partitions in a generally vertical orientation as they are compiled into bundles, said support means further comprising means gripping the collapsed partitions at their top and bottom edges upon release from said collecting means, means for supporting the downstream side of each bundle as it is formed, said downstream side support means being automatically retracted when a bundle is formed, and means biasing said downstream side support means against said bundle while said bundle is being formed, said collecting means including slot means, a conveyor means that is displaced from said slot means and also from the point where each bundle is compiled, and means for moving each bundle from said point where each bundle is compiled onto said conveyor means.

25. A machine for processing assembled box partitions comprising means for collapsing the assembled partitions to a generally flat configuration, means for collecting each collapsed partition and compiling successive collapsed partitions into bundles, means for supporting the partitions in a generally vertical orientation as they are compiled into bundles, said support means further comprising means gripping the collapsed partitions at their top and bottom edges upon release from said collecting means, means for supporting the downstream side of each bundle as it is formed, said downstream side support means being automatically retracted when a bundle is formed, and means biasing said downstream side support means against said bundle while said bundle is being formed, said collecting means including slot means, a conveyor means that is displaced from said slot means and also from the point where each bundle is compiled, means for moving each bundle from said point where each bundle is compiled onto said conveyor means, and said bundle moving means further comprising members engaging the upstream side of said bundle after it is formed to move the bundle from said point where each bundle is compiled onto said conveyor means.

26. A machine for processing assembled box partitions comprising means for collapsing the assembled partitions to a generally flat configuration, means for collecting each collapsed partition and compiling successive collapsed partitions into bundles, means for supporting the partitions in a generally vertical orientation as they are compiled into bundles, said support means further comprising means gripping the collapsed partitions at their top and bottom edges upon release from said collecting means, means for supporting the downstream side of each bundle as it is formed, said downstream side support means being automatically retracted when a bundle is formed, and means biasing said downstream side support means against said bundle while said bundle is being formed, said support means holding said collapsed partitions in spaced relation in said generally vertical orientation prior to the time said collapsed partitions are compiled into bundles, further comprising means detecting when a preselected number of spaced collapsed partitions have been compiled with other collapsed partitions to form a bundle, and means responsive to said detecting means for actuating said bundle moving means to move said bundle onto said conveyor means.

27. A machine for processing assembled box partitions comprising means for collapsing the assembled partitions to a generally flat configuration, means for collecting each collapsed partition and compiling successive collapsed partitions into bundles, means for supporting the partitions in a generally vertical orientation as they are compiled into bundles, said support means further comprising means gripping the collapsed partitions at their top and bottom edges upon release from said collecting means, means for supporting the downstream side of each bundle as it is formed, said downstream side support means being automatically retracted when a bundle is formed, and means biasing said downstream side support means against said bundle while said bundle is being formed, said collecting means further comprising a plurality of spaced-apart slot means for receiving said collapsed partitions and holding said collapsed partitions for movement toward a position wherein they can be compiled into bundles, further comprising means to index said slot means, further comprising conveyor means displaced from said slot means and also from the point where each bundle is compiled, further comprising means for moving each bundle from said point where each bundle is compiled onto said conveyor means, further comprising means for actuating said conveyor means after each bundle is pushed thereon to convey said bundle along a path generally normal to the path of the partitions as they are indexed in said slot means, and further comprising means for deactuating said conveyor means, after each bundle is conveyed, for receipt of the next bundle thereon.

28. A machine for processing assembled box partitions comprising means for collapsing the assembled partitions to a generally flat configuration, means for collecting each collapsed partition and compiling successive collapsed partitions into bundles, means for supporting the partitions in a generally vertical orientation as they are compiled into bundles, said support means further comprising means gripping the collapsed partitions at their top and bottom edges upon release from said collecting means, means for supporting the downstream side of each bundle as it is formed, said downstream side support means being automatically retraqted when a bundle is formed, and means biasing said downstream side support means against said bundle while said bundle is being formed, said collecting means further comprising a plurality of spaced-apart slot means for receiving said collapsed partitions and holding said collapsed partitions for spaced-apart movement toward a position wherein they can be compiled into bundles, a conveyor means that can receive and convey each bundle, a means that moves each bundle onto said conveyor means, means that detects when a collapsed partition is received in a slot means, and means responsive to said detecting means for indexing said slot means for receipt of the next collapsed partition.

29. A machine for processing assembled box partitions comprising means for collapsing the assembled partitions to a generally flat configuration, means for collecting each collapsed partition and compiling successive collapsed partitions into bundles, means for supporting the partitions in a generally vertical orientation as they are compiled into bundles, said support means further comprising means gripping the collapsed partitions at their top and bottom edges upon release from said collecting means, means for supporting the downstream side of each bundle as it is formed, said downstream side support means being automatically retracted when a bundle is formed, and means biasing said downstream side support means against said bundle while said bundle is being formed, said collecting means further comprising a plurality of spaced-apart slot means for receiving said collapsed partitions and holding said collapsed partitions for spaced-apart movement toward a position wherein they can be compiled into bundles, a conveyor means that can receive and convey each bundle, a means that moves each bundle onto said conveyor means, and said conveyor means further comprising upper and lower conveyors engaging the top and bottom of each bundle moved thereon.

30. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, a strapping means that straps the bundles to hold the collapsed partitions of each bundle together, said strapping means further comprising a strapper for applying a strap to each bundle at a strapping station, means for holding the partitions of a bundle generally vertical while conveying each bundle to said strapping station, means for detecting the presence of a bundle at said station, and means responsive to said detecting means for applying at least one strap to said bundle.

31. A machine for processing assembled box partitions, said machine comprsing means for collapsing the assembled partitions to a flat, generally vertical, configuration, said collapsing means applying positive advancing forces to each assembled partition to force said assembled partition to move along a predetermined path, said collapsing means holding said assembled partitions generally vertical while said assembled partitions are moved along said predetermined path, said collapsing means collapsinq and further advancing individual collapsed partitions along said predetermined path prior to compiling and bundling said collapsed partitions, further comprising conveyor means, means for moving each bundle onto said conveyor means, a strapping means that straps the bundles to hold the collapsed partitions of each bundle together, said conveying means further comprising a horizontal conveyor on which each bundle rides, and vertical, horizontally-acting conveyors that engage each bundle at each side thereof, for conveying each bundle toward said strapping station.

32. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, further comprising conveyor means, means for moving each bundle onto said conveyor means, a strapping means that straps the bundles to hold the collapsed partitions of each bundle together, said conveying means further comprising a horizontal conveyor on which each bundle rides, and vertical, horizontally-acting conveyors that engage each bundle at each side thereof, for conveying each bundle toward said strapping station, at least one of said vertical, horizontally-acting conveyors being transversely adjustable to accommodate bundles of various widths.

33. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, further comprising conveyor means, means for moving each bundle onto said conveyor means, a strapping means that straps the bundles to hold the collapsed partitions of each bundle together, said conveying means further comprising a horizontal conveyor on which each bundle rides, and vertical, horizontally-acting conveyors that engage each bundle at each side thereof, for conveying each bundle toward said strapping station, said bundles varying in width along the length thereof, and said vertical, horizontally-acting conveyors having retractable means biased into engagement with the sides of each bundle as it moves therethrough to accommodate the varying width of each bundle along its length.

34. A machine for processing assembled box partitions, said machine comprising means for collapsing the assembled partitions to a flat, generally vertical, configuration, said collapsing means applying positive advancing forces to each assembled partition to force said assembled partitions to move along a predetermined path, said collapsing means holding said assembled partitions generally vertical while said assembled partitions are moved along said predetermined path, said collapsing means collapsing and further advancing individual collapsed partitions along said predetermined path prior to compiling and bundling said collapsed partitions, further comprising conveyor means, means for moving each bundle onto said conveyor means, a strapping means that straps the bundles to hold the collapsed partitions of each bundle together, said conveying means further comprising a horizontal conveyor on which each bundle rides, and vertical, horizontally-acting conveyors that engage each bundle at each side thereof, for conveying each bundle toward said strapping station, said bundles varying in width along the length thereof, and said vertical, horizontally-acting conveyors having retractable means biased into engagement with the sides of each bundle as it moves therethrough to accommodate the varying width of each bundle along its length, said retractable means being opposed arms biased toward each other at the upstream and downstream ends of said vertical, horizontally-acting conveyors.

* * * * *